US011299870B2

(12) United States Patent
Kumakura et al.

(10) Patent No.: US 11,299,870 B2
(45) Date of Patent: Apr. 12, 2022

(54) DISPLAY SYSTEM FOR EXCAVATION MACHINE, EXCAVATION MACHINE, AND DISPLAY METHOD FOR EXCAVATION MACHINE

(71) Applicant: Komatsu Ltd., Tokyo (JP)

(72) Inventors: Yoshito Kumakura, Tokyo (JP); Satoru Shintani, Tokyo (JP); Daiki Arimatsu, Tokyo (JP)

(73) Assignee: Komatsu Ltd., Tokyo (JP)

( * ) Notice: Subject to any disclaimer, the term of this patent is extended or adjusted under 35 U.S.C. 154(b) by 309 days.

(21) Appl. No.: 16/487,850

(22) PCT Filed: Aug. 31, 2017

(86) PCT No.: PCT/JP2017/031501
§ 371 (c)(1),
(2) Date: Aug. 22, 2019

(87) PCT Pub. No.: WO2019/043897
PCT Pub. Date: Mar. 7, 2019

(65) Prior Publication Data

US 2021/0131075 A1 May 6, 2021

(51) Int. Cl.
*E02F 9/26* (2006.01)
*E02F 3/32* (2006.01)
*E02F 3/42* (2006.01)

(52) U.S. Cl.
CPC ..... *E02F 9/264* (2013.01); *E02F 3/32* (2013.01); *E02F 3/425* (2013.01)

(58) Field of Classification Search
CPC ... E02F 3/32; E02F 3/425; E02F 3/435; E02F 9/261; E02F 9/264
See application file for complete search history.

(56) References Cited

U.S. PATENT DOCUMENTS 9,828,747 B2 11/2017 Arimatsu et al.
2014/0099178 A1* 4/2014 Nomura ..... E02F 9/26 414/685

(Continued)

FOREIGN PATENT DOCUMENTS

CN 105358771 A 2/2016
JP 2014-074319 A 4/2014

(Continued)

OTHER PUBLICATIONS

International Search Report dated Nov. 28, 2017, issued for PCT/JP2017/031501.

(Continued)

*Primary Examiner* — Tyler J Lee
(74) *Attorney, Agent, or Firm* — Locke Lord LLP

(57) ABSTRACT

A display system for an excavation machine includes a calculator configured to calculate, based on vehicle state data indicating a position and a posture of a vehicle body of an excavation machine, working equipment outer shape data indicating an outer shape and a dimension of working equipment supported by the vehicle body, and working equipment state data indicating a posture of the working equipment, a reference vector extending in a widthwise direction of a bucket of the working equipment and passing through a specified portion of the bucket, and a display controller configured to cause a display device to display the bucket and a target line viewed from a direction orthogonal to the reference vector.

6 Claims, 13 Drawing Sheets

(56) References Cited

U.S. PATENT DOCUMENTS

| | | | | |
|---|---|---|---|---|
| 2014/0100712 | A1* | 4/2014 | Nomura | E02F 9/264 701/1 |
| 2014/0100744 | A1* | 4/2014 | Johnson | E02F 3/3677 701/50 |
| 2015/0345114 | A1 | 12/2015 | Nomura et al. | |
| 2016/0010312 | A1* | 1/2016 | Kurihara | E02F 9/261 701/36 |
| 2016/0024757 | A1 | 1/2016 | Nomura et al. | |
| 2016/0237654 | A1 | 8/2016 | Arimatsu et al. | |
| 2016/0237655 | A1* | 8/2016 | Baba | E02F 9/2037 |
| 2016/0244950 | A1* | 8/2016 | Kami | G01C 15/00 |
| 2016/0251834 | A1* | 9/2016 | Arimatsu | E02F 9/26 414/687 |

FOREIGN PATENT DOCUMENTS

| | | | |
|---|---|---|---|
| JP | 2014-205955 | A | 10/2014 |
| JP | 5886962 | B1 | 3/2016 |
| KR | 10-2015-0142031 | A | 12/2015 |

OTHER PUBLICATIONS

Office Action dated Oct. 12, 2020 issued for Korean Patent Application No. 10-2019-7024640 and English translation thereof.

Office Action dated Aug. 4, 2020, issued for the corresponding Chinese patent application No. 201780087716.1 and English translation thereof.

* cited by examiner

DISPLAY SYSTEM FOR EXCAVATION MACHINE, EXCAVATION MACHINE, AND DISPLAY METHOD FOR EXCAVATION MACHINE

FIELD

The present invention relates to a display system for an excavation machine, the excavation machine, and a display method for the excavation machine.

BACKGROUND

The working equipment of an excavation machine such as an excavator is actuated when an operator operates an operating device such as a working lever. In performing excavation with the bucket of the working equipment in accordance with a target excavation landform illustrating the target shape of an excavation object, it is difficult for the operator to determine whether the excavation object is accurately excavated, simply by visually checking the condition of the working equipment. In addition, in order to accurately excavate the excavation object with the bucket, the operator is required to have a skilled technique. Accordingly, as disclosed in Patent Literature 1, there has been proposed a technique of assisting the operator to operate an operating device by displaying an image illustrating the relative position between a bucket and a target excavation landform on a display device provided in an operating room.

CITATION LIST

Patent Literature

Patent Literature 1: Japanese Patent No. 5886962

SUMMARY

Technical Problem

The display device displays an image of the bucket and the target excavation landform viewed from a given direction. Depending on the direction in which the bucket and the target excavation topography are viewed, the relative position between the bucket and a target line indicating the target excavation landform may not be accurately displayed. Assume that an image illustrating the relative position between a bucket having a plurality of rotation axes such as a tilt bucket and a target line is displayed on the display device. In this case, depending on the direction in which the bucket and the target line are viewed, the relative position between the bucket and the target line may not be accurately displayed as the bucket rotates. This may make the operator feel uncomfortable about the image displayed on the display device or may fail to sufficiently assist the operator to operate the operating device.

An aspect of the present invention aims to provide a technique that can accurately display a bucket and a target line.

Solution to Problem

According to an aspect of the present invention, a display system for an excavation machine, comprises: a calculator configured to calculate, based on vehicle state data indicating a position and a posture of a vehicle body of an excavation machine, working equipment outer shape data indicating an outer shape and a dimension of working equipment supported by the vehicle body, and working equipment state data indicating a posture of the working equipment, a reference vector extending in a widthwise direction of a bucket of the working equipment and passing through a specified portion of the bucket; and a display controller configured to cause a display device to display the bucket and a target line viewed from a direction orthogonal to the reference vector.

Advantageous Effects of Invention

According to an aspect of the present invention, a technique that can accurately display a bucket and a target line is provided.

DESCRIPTION OF EMBODIMENTS

Embodiments of the present invention will be described below with reference to the accompanying drawings, but the present invention is not limited to the embodiments. The constituent elements of the respective embodiments described below can be combined as appropriate. In addition, some constituent elements are not sometimes used.

In the following description, a three-dimensional global coordinate system (Xg, Yg, Zg) and a three-dimensional vehicle body coordinate system (Xm, Ym, Zm) are defined, and the positional relationship of each part is described.

The global coordinate system is a coordinate system based on an origin fixed to the earth. The global coordinate system is a coordinate system defined by the Global Navigation Satellite System (GNSS). GNSS stands for the Global Navigation Satellite System. One example of a global navigation satellite system is the Global Positioning System (GPS). GNSS includes a plurality of positioning satellites. GNSS detects the position defined by coordinate data of latitude, longitude, and altitude.

The global coordinate system is defined by the Xg-axis in a horizontal plane, the Yg-axis orthogonal to the Xg-axis in the horizontal plane, and the Zg-axis orthogonal to the Xg-axis and the Yg-axis. A direction parallel to the Xg-axis is defined as an Xg-axis direction, a direction parallel to the Yg-axis is defined as a Yg-axis direction, and a direction parallel to the Zg-axis is defined as a Zg-axis direction. A rotation or inclined direction about the Xg-axis is defined as a θXg direction, a rotation or inclined direction about the Yg-axis is defined as a θYg direction, and a rotation or inclined direction about the Zg-axis is defined as a θZg direction. The Zg-axis direction is the vertical direction.

The body coordinate system refers to a coordinate system based on an origin fixed to the excavation machine.

The vehicle body coordinate system is defined by the Xm-axis extending in one direction with reference to the origin fixed to the vehicle body of the excavation machine, the Ym-axis orthogonal to the Xm-axis, and the Zm-axis orthogonal to the Xm-axis and the Ym-axis. A direction parallel to the Xm-axis is defined as an Xm-axis direction, a direction parallel to the Ym-axis is defined as a Ym-axis direction, and a direction parallel to the Zm-axis is defined as a Zm-axis direction. A rotation or inclined direction about the Xm-axis is defined as a θXm direction, a rotation or inclined direction about the Ym-axis is defined as a θYm direction, and a rotation or inclined direction about the Zm-axis is defined as a θZm direction. The Xm-axis direction is the longitudinal direction of the excavation machine, the Ym-axis direction is the vehicle body width direction of the excavation machine, and the Zm-axis direction is the vertical direction of the excavation machine.

[Excavation Machine]

Figure 1:
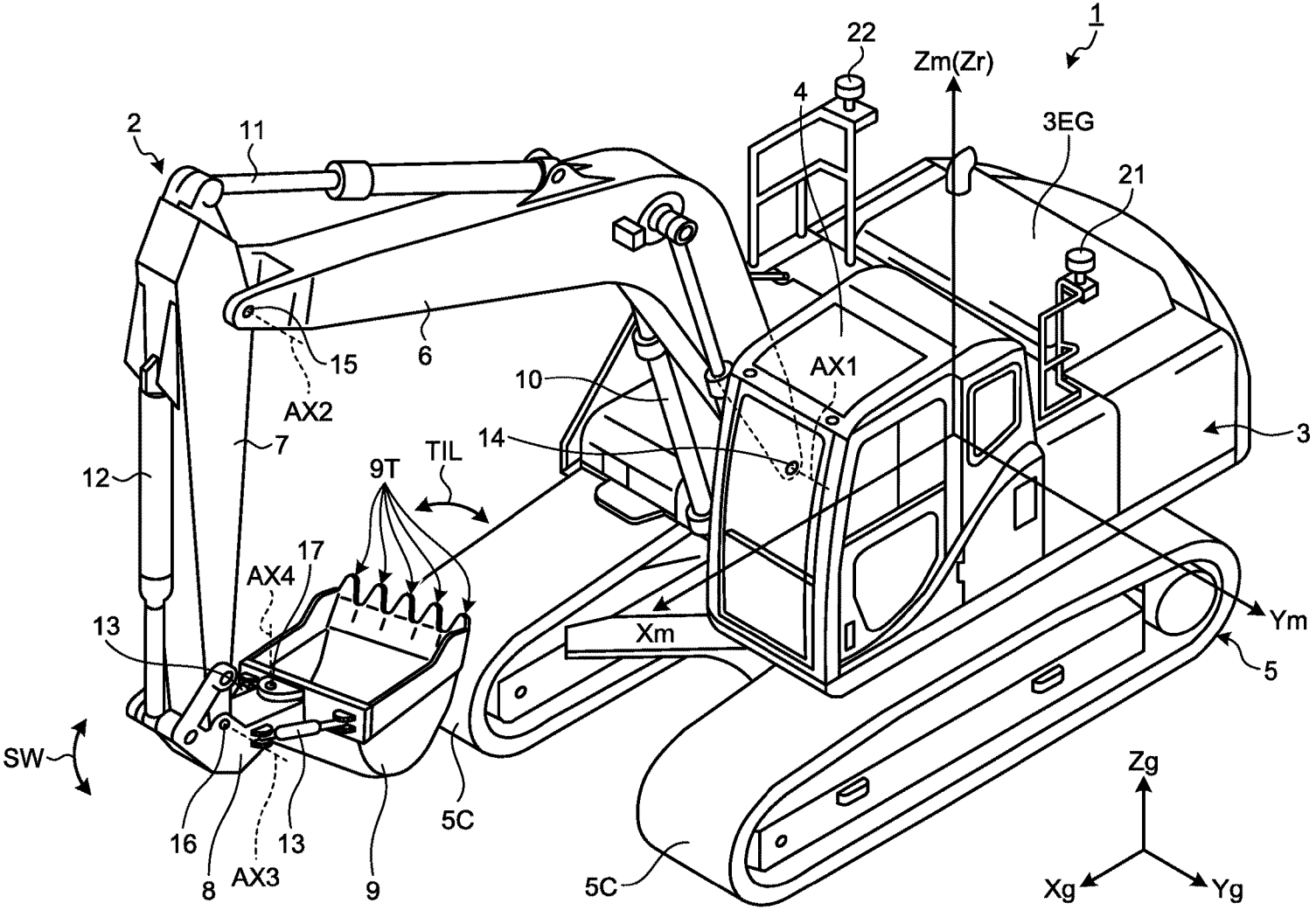
FIG. 1 is a perspective view illustrating an example of an excavation machine according to the present embodiment.

FIG. 1 is a perspective view illustrating an example of an excavation machine 1 according to the present embodiment. The present embodiment will exemplify a case in which the excavation machine 1 is an excavator. In the following description, the working machine 1 will be referred to as the excavator 1 as appropriate.

As illustrated in FIG. 1, the excavator 1 includes working equipment 2 that is hydraulically actuated, a swing body 3 that is a vehicle body supporting the working equipment 2, and a traveling device 5 supporting the swing body 3.

The swing body 3 can swing about a swing axis Zr while being supported by the traveling device 5. The swing body 3 includes an operating room 4 and an engine room 3EG. The operator of the excavator 1 boards the operating room 4. The engine room 3EG accommodates a power source and a hydraulic pump. The power source includes, for example, an internal-combustion engine such as a diesel engine. Note that the power source may be a hybrid power source in which an internal-combustion engine, a generator motor, and a storage device are combined.

The swing body 3 is provided with GNSS antennas 21 and 22 used to detect the position of the swing body 3 in the global coordinate system.

The traveling device 5 supports the swing body 3. The traveling device 5 includes a pair of crawler tracks 5C. As the crawler tracks 5C rotate, the excavator 1 travels. Note that the traveling device 5 may include wheels (tires).

The working equipment 2 is supported by the swing body 3. The working equipment 2 includes a boom 6 coupled to the swing body 3 via a boom pin 14, an arm 7 coupled to the boom 6 via an arm pin 15, a coupling member 8 coupled to the arm 7 via a bucket pin 16, and a bucket 9 coupled to the coupling member 8 via a tilt pin 17. The bucket 9 is a tilt bucket. The bucket 9 has blade edges 9T. Each blade edge 9T of the bucket 9 is a distal end portion of a convex blade. A plurality of blade edges 9T are provided on the bucket 9 in the widthwise direction. Note that the blade edge 9T of the bucket 9 may be a distal end portion of a straight shape.

The boom 6 can rotate about a rotation axis AX1 passing through the boom pin 14 relative to the swing body 3. The arm 7 can rotate about a rotation axis AX2 passing through the arm pin 15 relative to the boom 6. The coupling member 8 can rotate about a rotation axis AX3 passing through the bucket pin 16 relative to the arm 7. The bucket 9 can rotate about a rotation axis AX4 passing through the tilt pin 17 relative to the coupling member 8.

The rotation axis AX1, the rotation axis AX2, and the rotation axis AX3 are parallel to each other. The rotation axes AX1, AX2, and AX3 are orthogonal to an axis parallel to the swing axis Zr. The rotation axis AX3 and the rotation axis AX4 face different directions. In the present embodiment, the rotation axis AX3 is orthogonal to an axis parallel to the rotation axis AX4.

The rotation axes AX1, AX2, and AX3 are parallel to the Ym-axis of the vehicle body coordinate system. The swing axis Zr is parallel to the Zm-axis of the vehicle body coordinate system. A direction parallel to the rotation axes AX1, AX2, and AX3 indicates the vehicle body width direction of the swing body 3. A direction parallel to the swing axis Zr indicates the vertical direction of the swing body 3. A direction orthogonal to both the rotation axes AX1, AX2, and AX3 and the swing axis Zr indicates the front-rear direction of the swing body 3.

The direction in which the working equipment 2 is present with reference to the operating room 4 corresponds to the front, and the direction in which the engine room 3EG is present with reference to the operating room 4 corresponds to the rear. The direction in which the traveling device 5 is present with reference to the swing body 3 corresponds to downward, and the direction in which the swing body 3 is present with reference to the traveling device 5 corresponds to upward. The direction away from the boom 6 with reference to the driver's seat disposed in the operating room 4 and facing forward corresponds to leftward, and the direction approaching the boom 6 with reference to the driver's seat corresponds to rightward.

The working equipment 2 is actuated by the power generated by a hydraulic cylinder. The hydraulic cylinder that actuates the working equipment 2 includes a boom cylinder 10 that actuates the boom 6, an arm cylinder 11 that actuates the arm 7, a bucket cylinder 12 that actuates the coupling member 8, and tilt cylinders 13 that actuate the bucket 9. The boom cylinder 10 can generate power that rotates the boom 6 about the rotation axis AX1. The arm cylinder 11 can generate power that rotates the arm 7 about the rotation axis AX2. The bucket cylinder 12 can generate power that rotates the coupling member 8 about the rotation axis AX3. The tilt cylinders 13 can generate power that rotates the bucket 9 about the rotation axis AX4.

[Bucket]

Figure 2:
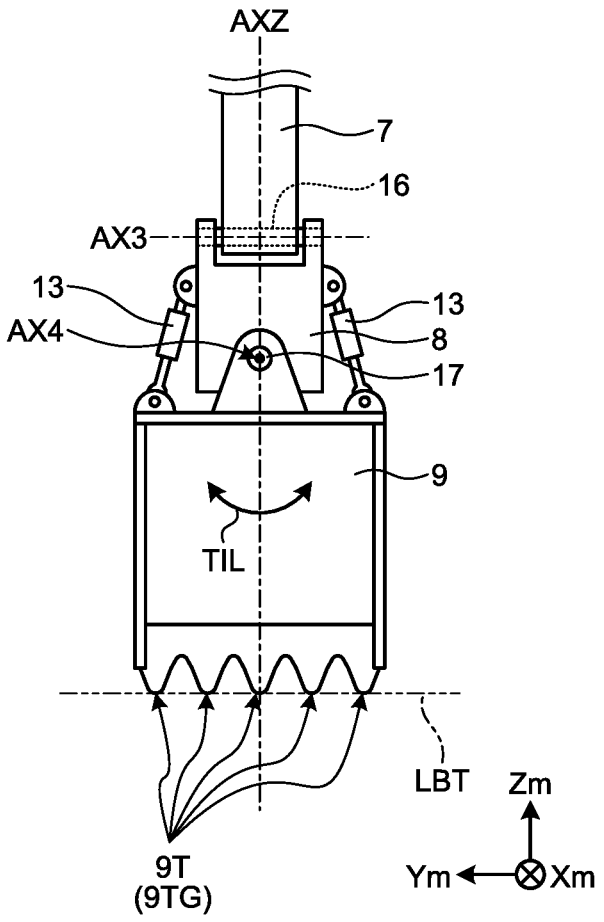
FIG. 2 is a front view illustrating an example of a bucket according to the present embodiment.

FIG. 2 is a front view illustrating an example of the bucket 9 according to the present embodiment. As illustrated in FIGS. 1 and 2, the bucket 9 is coupled to the arm 7 via the coupling member 8. The coupling member 8 is coupled to the arm 7 so as to be rotatable about the rotation axis AX3. The bucket 9 is coupled to the coupling member 8 so as to be rotatable about the rotation axis AX4. As the coupling member 8 rotates about the rotation axis AX3, the bucket 9 rotates about the rotation axis AX3. That is, the bucket 9 is supported by the arm 7 so as to be rotatable about the rotation axis AX3 (first rotation axis) and the rotation axis AX4 (second rotation axis) facing a direction different from that of the rotation axis AX3.

In the following description, the rotation axis AX3 will be referred to as the bucket rotation axis AX3 as needed, and the rotation axis AX4 will be referred to as the tilt rotation axis AX4 as needed. In the following description, the rotation of the bucket 9 about the bucket rotation axis AX3 will be referred to as bucket rotation as needed, and the rotation of the bucket 9 about the tilt rotation axis AX4 will be referred to as tilt rotation as needed. An arrow SW illustrated in FIG. 1 indicates the direction of the bucket rotation of the bucket 9. An arrow TIL illustrated in FIGS. 1 and 2 indicates the direction of the tilt rotation of the bucket 9.

The bucket 9 has a plurality of blade edges 9T. The plurality of blade edges 9T are arrayed in the widthwise direction of the bucket 9. The widthwise direction of the bucket 9 corresponds to a direction orthogonal to the tilt rotation axis AX4. The plurality of blade edges 9T constitute a blade edge array 9TG. The blade edge array 9TG is an aggregate of blade edges 9T. In the following description, a straight line connecting the plurality of blade edges 9T will be referred to as a blade edge line LBT as needed.

Note that when the bucket 9 has the blade edge 9T in a straight shape, the blade edge line LBT is defined in the extending direction of the blade edge 9T in a straight shape.

The tilt cylinders 13 are coupled to the coupling member 8 and the bucket 9. The tilt cylinders 13 are arranged on one and the other sides of the coupling member 8 in the Ym-axis direction. As one tilt cylinder 13 extends and the other tilt cylinder 13 contracts, the bucket 9 tilts and rotates. Note that the number of tilt cylinders 13 may be one.

As illustrated in FIG. 2, when an axis AXZ orthogonal to both the bucket rotation axis AX3 and the tilt rotation axis AX4 is defined, as the bucket 9 rotates, the blade edge line LBT of the bucket 9 tilts relative to the axis AXZ. When the blade edge line LBT is orthogonal to the axis AXZ, the widthwise direction of the bucket 9 coincides with the vehicle width direction of the swing body 3.

[Detection System]

Figure 3:
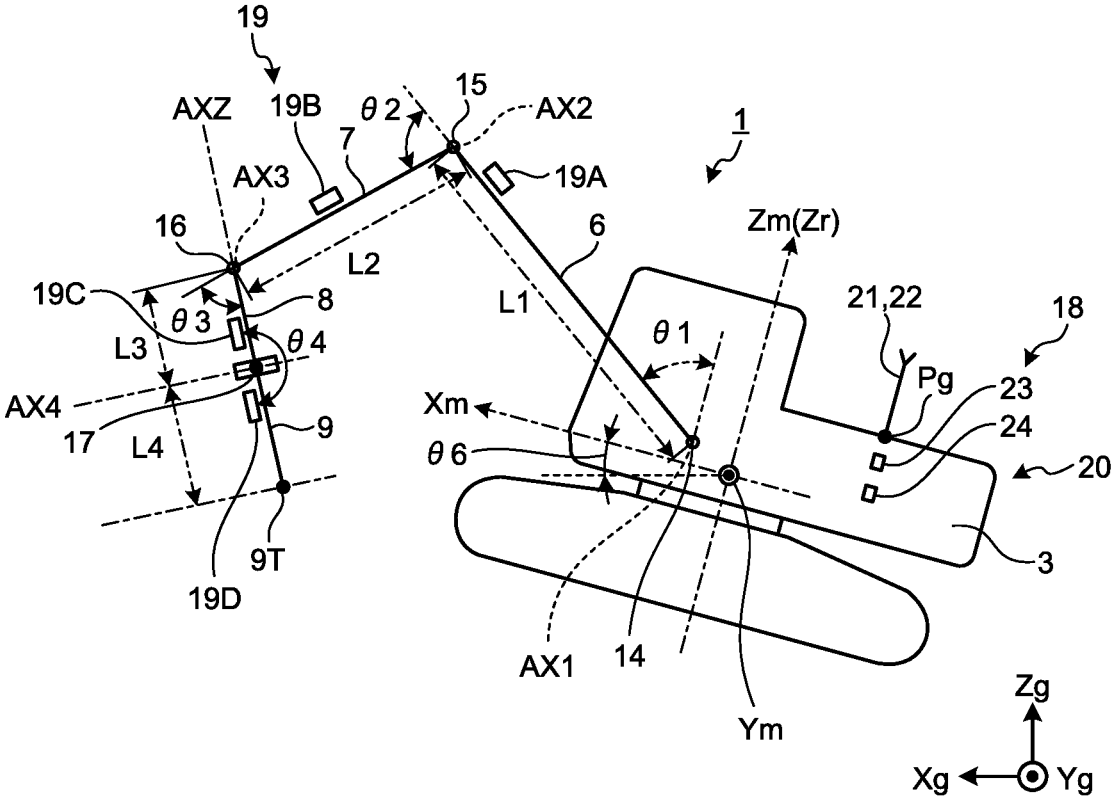
FIG. 3 is a side view schematically illustrating the excavation machine according to the present embodiment.
Figure 4:
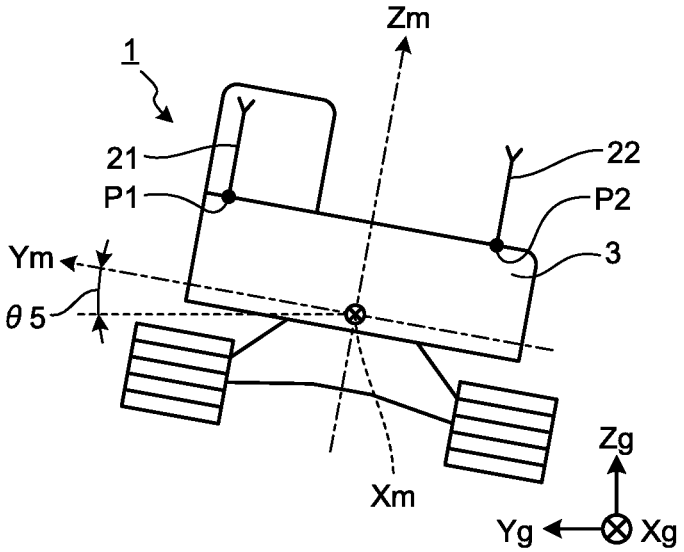
FIG. 4 is a rear view schematically illustrating the excavation machine according to the present embodiment.
Figure 5:
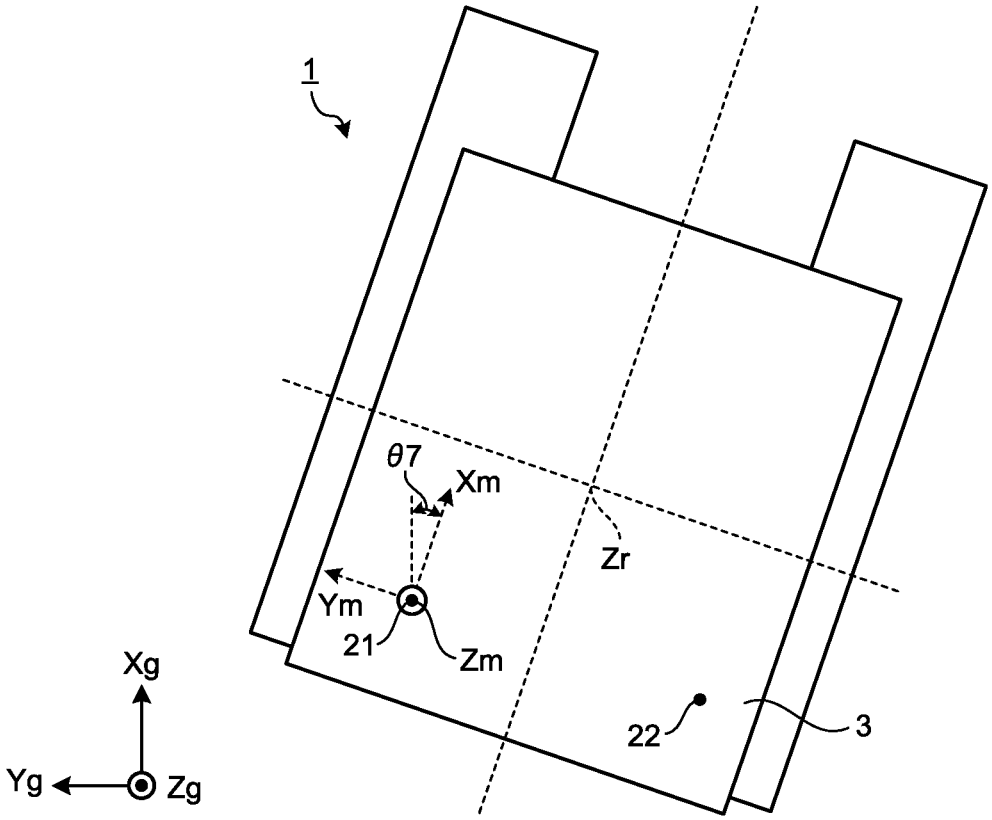
FIG. 5 is a plan view schematically illustrating the excavation machine according to the present embodiment.
Figure 6:
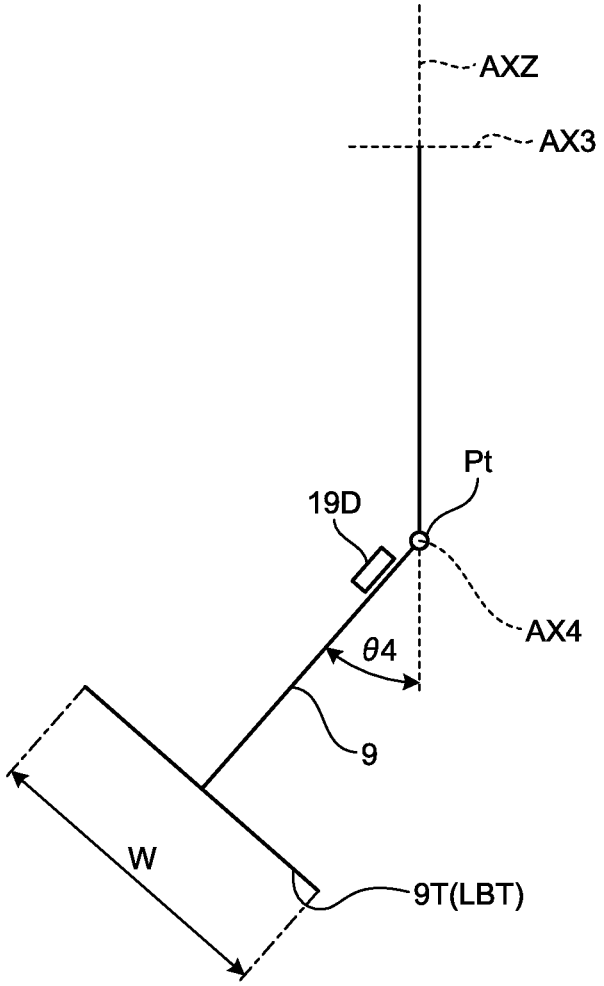
FIG. 6 is a front view schematically illustrating working equipment according to the present embodiment.

A detection system 18 of the excavator 1 according to the present embodiment will be described next. FIG. 3 is a side view schematically illustrating the excavator 1 according to the present embodiment. FIG. 4 is a rear view schematically illustrating the excavator 1 according to the present embodiment. FIG. 5 is a plan view schematically illustrating the excavator 1 according to the present embodiment. FIG. 6 is a front view schematically illustrating the working equipment 2 according to the present embodiment.

The detection system 18 includes a position detector 20 that detects the position of the swing body 3 and a working equipment angle detector 19 that detects the angle of the working equipment 2.

The position detector 20 includes a position calculator 23 that detects the position of the swing body 3 and a posture calculator 24 that detects the posture of the swing body 3.

The position calculator 23 includes a GPS receiver. The position calculator 23 is provided for the swing body 3. The position calculator 23 detects a position Pg of the swing body 3 in the global coordinate system. The position Pg of the swing body 3 includes coordinate data in the Xg-axis direction, coordinate data in the Yg-axis direction, and coordinate data in the Zg-axis direction.

The swing body 3 is provided with the GNSS antennas 21 and 22. The GNSS antennas 21 and 22 receive radio waves from the positioning satellites and output signals generated based on the received radio waves to the position calculator 23. The position calculator 23 detects positions P1 and P2 of the GNSS antennas 21 and 22 in the global coordinate system on the basis of signals from the GNSS antennas 21 and 22. The position calculator 23 detects the position Pg of the swing body 3 on the basis of the positions P1 and P2 of the GNSS antennas 21 and 22.

The GNSS antennas 21 and 22 are provided in the vehicle width direction. The position calculator 23 calculates the position Pg of the swing body 3 by executing arithmetic processing on the basis of at least one of the position P1 and the position P2. In the present embodiment, a position Pb of the swing body 3 is the position P1. Note that the position Pg of the swing body 3 may be the position P2 or a position between the position P1 and the position P2.

The posture calculator 24 includes an inertial measurement unit (IMU). The posture calculator 24 is provided for the swing body 3. The posture calculator 24 detects the acceleration and angular velocity exerted on the posture calculator 24. The posture calculator 24 detects an acceleration and an angular velocity acting on the swing body 3 by detecting an acceleration and an angular velocity acting on the posture calculator 24. The posture calculator 24 calculates the posture of the swing body 3 including a roll angle θ5 and a pitch angle θ6 by executing arithmetic processing on the basis of an acceleration and an angular velocity acting on the swing body 3. The roll angle θ5 is the tilt angle of the swing body 3 relative to a horizontal plane in the vehicle width direction. The pitch angle θ6 is the tilt angle of the swing body 3 relative to a horizontal plane in the front-rear direction.

An azimuth angle θ7 (yaw angle) is calculated on the basis of detection data from the position calculator 23. The azimuth angle θ7 is the tilt angle of the swing body 3 relative to a reference azimuth. The reference azimuth is, for example, North. The position calculator 23 can calculate the azimuth angle θ7 of the swing body 3 on the basis of the positions P1 and P2 of the GNSS antennas 21 and 22. The position calculator 23 can calculate a straight line connecting the position P1 and the position P2 and calculate the azimuth angle θ7 of the swing body 3 on the basis of the angle formed by the calculated straight line and the reference azimuth. Note that the posture calculator 24 may calculate the azimuth angle θ7 by executing arithmetic processing on the basis of an acceleration and an angular velocity acting on the swing body 3.

The working equipment angle detector 19 includes a boom stroke sensor 19A that detects the stroke value of the boom cylinder 10, an arm stroke sensor 19B that detects the stroke value of the arm cylinder 11, a bucket stroke sensor 19C that detects the stroke value of the bucket cylinder 12, a tilt stroke sensor 19D that detects the stroke value of the tilt cylinder 13, and a tilt angle calculator. The tilt angle calculator calculates a tilt angle θ1 of the boom 6 relative to the Zm-axis of the vehicle body coordinate system on the basis of the stroke value detected by the boom stroke sensor 19A. The tilt angle calculator calculates a tilt angle θ2 of the arm 7 relative to the boom 6 on the basis of the stroke value detected by the arm stroke sensor 19B. The tilt angle calculator calculates a tilt angle θ3 of the blade edge 9T of the bucket 9 relative to the arm 7 on the basis of the stroke value detected by the bucket stroke sensor 19C. The tilt angle calculator calculates a tilt angle θ4 of the bucket 9 relative to the axis AXZ on the basis of the stroke value detected by the tilt stroke sensor 19D. As illustrated in FIG. 6, the tilt angle θ4 of the bucket 9 is the angle formed by the axis AXZ and a line orthogonal to the blade edge line LBT of the bucket 9.

Note that the tilt angles θ1, θ2, θ3, and θ4 may be detected by, for example, an angle sensor provided for the working equipment 2.

[Control System]

Figure 7:
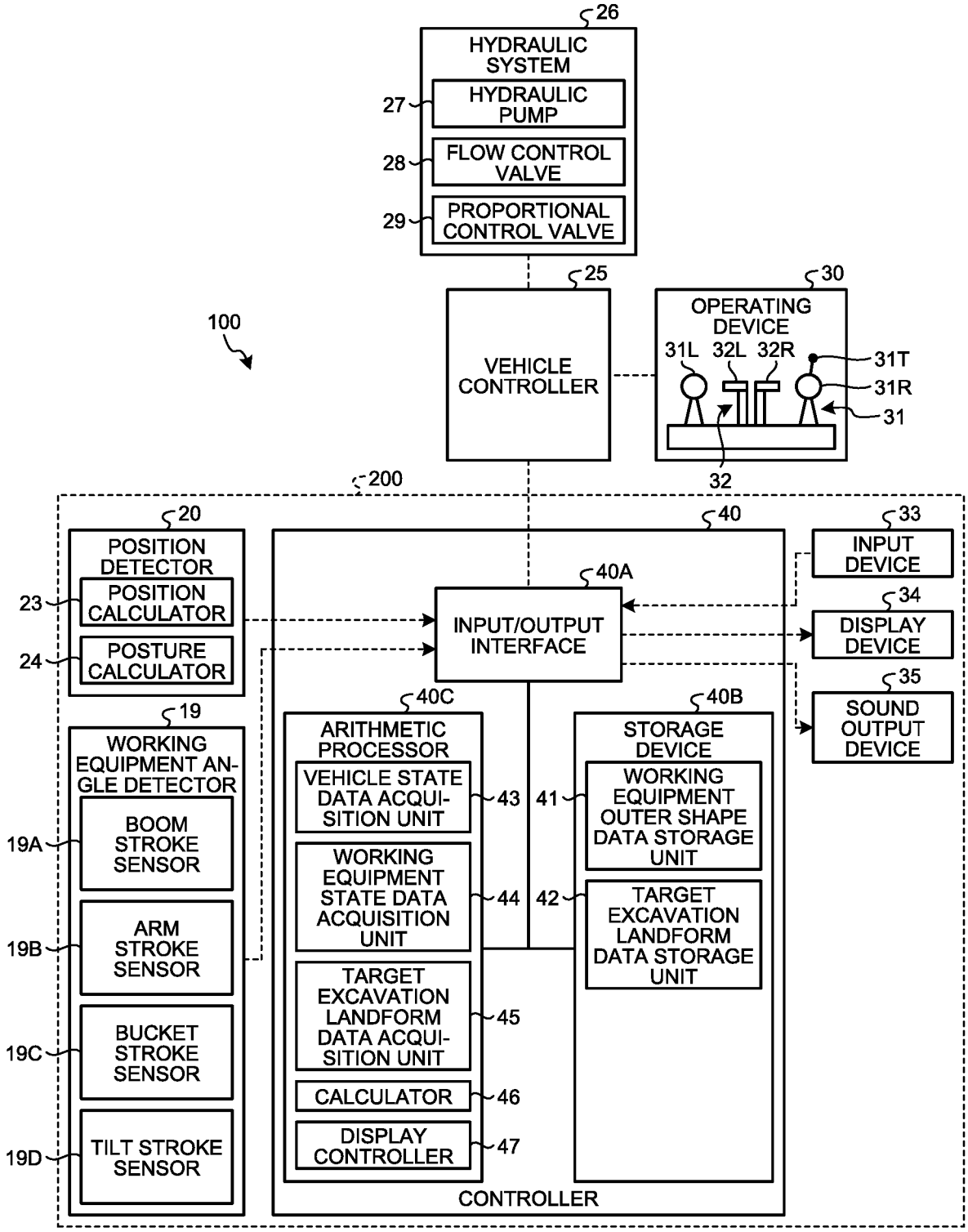
FIG. 7 is a functional block diagram illustrating an example of the control system of the excavation machine according to the present embodiment.

A control system 100 of the excavator 1 according to the present embodiment will be described next. FIG. 7 is a functional block diagram illustrating an example of the control system 100 of the excavator 1 according to the present embodiment.

As illustrated in FIG. 7, the excavator 1 includes a vehicle controller 25, a hydraulic system 26, an operating device 30, and a display system 200.

The operating device 30 is operated by the operator for the actuation of the working equipment 2, the swinging of the swing body 3, and the traveling of the traveling device 5. The operating device 30 is disposed in the operating room 4. The operating device 30 includes an operating member operated by the operator of the excavator 1. The operating device 30 includes a working lever 31 for operating the working equipment 2 and the swing body 3 and a traveling lever 32 for operating the traveling device 5.

The working lever 31 includes a right working lever 31R, a left working lever 30L, and a tilt lever 30T. The traveling lever 32 includes a right traveling lever 32R and a left traveling lever 32L.

When the right working lever 31R is operated in the front-rear direction, the boom 6 is actuated downward or upward. When the right working lever 31R is operated in the left-right direction, the bucket 9 rotates to perform an excavating operation or dumping operation. When a tilt lever 31T is operated, the bucket 9 tilts and rotates to make the blade edge line LBT tilt rightward or leftward relative to the axis AXZ. Note that the bucket 9 may be made to tilt and rotate by operating an operating pedal that is operated by the operator's foot.

When a left working lever 31L is operated in the front-rear direction, the arm 7 is actuated for a dumping operation or excavating operation. When the left working lever 31L is operated in the left-right direction, the swing body 3 swings left or right.

When the right traveling lever 32R is operated in the front-rear direction, the right crawler track 5C of the pair of the crawler tracks 5C rotates so as to move forward or backward. When the left traveling lever 32L is operated in the front-rear direction, the left crawler track 5C of the pair of the crawler tracks 5C rotates so as to move forward or backward.

The vehicle controller 25 includes an input/output interface, a storage device including a volatile memory such as a random access memory (RAM) and a nonvolatile memory such as a read only memory (ROM), and an arithmetic processor including a processor such as a central processing unit (CPU). The vehicle controller 25 outputs control signals for controlling the working equipment 2 and the swing body 3.

The hydraulic system 26 includes a hydraulic pump 27 that discharges hydraulic oil, a flow control valve 28 that adjusts the supply amount and supply direction of hydraulic oil supplied to each hydraulic cylinder (10, 11, 12, and 13) for actuating the working equipment 2, and a proportional control valve 29 that adjusts a pilot pressure acting on the flow control valve 28. The pilot pressure acting on the flow control valve 28 is adjusted on the basis of the operation amount of the working lever 31. The spool of the flow control valve 28 moves on the basis of a pilot pressure to adjust the supply amount and supply direction of hydraulic oil supplied to each hydraulic cylinder. Note that the working lever 31 may be of a pilot pressure system or electric system. When the working lever 31 is of an electric system, the operation amount of the working lever 31 is detected by an operation amount sensor such as a potentiometer. The detection signal from the operation amount sensor is output to the vehicle controller 25. The vehicle controller 25 can output a control signal for controlling the proportional control valve 29 on the basis of a detection signal from the operation amount sensor.

The hydraulic system 26 includes a hydraulic motor for travelling the traveling device 5. The traveling lever 32 is operated to adjust the supply amount and supply direction of hydraulic oil supplied from the hydraulic pump 27 to the hydraulic motor. The traveling lever 32 may be of a pilot pressure system or electric system.

[Display System]

The display system 200 displays the relative position between the bucket 9 of the working equipment 2 and an excavation object to assist the operation of the operating device 30 by the operator.

As illustrated in FIG. 6, the display system 200 includes the position detector 20, the working equipment angle detector 19, an input device 33, a display device 34, a sound output device 35, and a controller 40. The input device 33, the display device 34, and the sound output device 35 each are provided in the operating room 4. In the present embodiment, the input device 33, the display device 34, and the sound output device 35 are integrally arranged. Note that the input device 33, the display device 34, and the sound output device 35 may be separately arranged.

The position detector 20 includes the position calculator 23 and the posture calculator 24. The working equipment angle detector 19 includes the boom stroke sensor 19A, the arm stroke sensor 19B, the bucket stroke sensor 19C, and the tilt stroke sensor 19D.

The operator operates the input device 33. Operating the input device 33 will generate an input signal for operating the display system 200. As the input device 33, at least one of an operation switch, an operation button, a touch panel, and a keyboard is exemplified.

The display device 34 displays display data for assisting the operation of the operating device 30 by the operator. The display data displayed on the display device 34 includes an image illustrating the relative position between the bucket 9 and an excavation object. As the display device 34, a liquid crystal display (LCD) or a flat panel display such as an organic electroluminescence display (OELD) is exemplified.

The sound output device 35 outputs a warning sound to assist the operation of the operating device 30 by the operator. As the sound output device 35, at least one of a loudspeaker, a siren, and a speech output device is exemplified.

The controller 40 includes an input/output interface 40A, a storage device 40B including a volatile memory such as a random access memory (RAM) and a nonvolatile memory such as a read only memory (ROM), and an arithmetic processor 40C including a processor such as a central processing unit (CPU).

The input/output interface 40A includes an interface circuit that connects the storage device 40B and the arithmetic processor 40C to an external device. The input/output interface 40A is connected to each of the position detector 20, the working equipment angle detector 19, the input device 33, the display device 34, and the sound output device 35.

The storage device 40B includes a working equipment outer shape data storage unit 41 and a target excavation landform data storage unit 42.

The working equipment outer shape data storage unit 41 stores working equipment outer shape data. Working equipment outer shape data indicates the outer shape and dimensions of the working equipment 2. The working equipment outer shape data is known data known from the design data or specification data of the excavator 1, and is stored in the working equipment outer shape data storage unit 41.

The working equipment outer shape data includes a length L1 of the boom 6, a length L2 of the arm 7, a length L3 of the coupling member 8, and a length L4 of the bucket 9. As illustrated in FIG. 3, the length L1 of the boom 6 is the length from the center of the boom pin 14 to the center of the arm pin 15. The length L2 of the arm 7 is the length from the center of the arm pin 15 to the center of the bucket pin 16. The length L3 of the coupling member 8 is the length from the center of the bucket pin 16 to the center of the tilt pin 17. The length L4 of the bucket 9 is the length from the center of the tilt pin 17 to the blade edge 9T of the bucket 9.

The working equipment outer shape data includes bucket outer shape data indicating the outer shape and dimensions of the bucket 9. The bucket outer shape data includes a width W of the bucket 9 and coordinate data of the bucket 9. The coordinate data of the bucket 9 includes the coordinate data of the blade edge 9T of the bucket 9 and the coordinate data of each of a plurality of points on the outer surface of the bucket 9. Note that when the bucket 9 is replaced, the bucket outer shape data about the replaced bucket 9 is input to the working equipment data storage unit 41 via the input device 33.

The target excavation landform data storage unit 42 stores target excavation landform data indicating the target excavation landform of the excavation object. The target excavation landform indicates the target shape of the excavation object. The target excavation landform is created in advance and stored in the target excavation landform data storage unit 42.

The target excavation landform data includes three-dimensional data indicating the three-dimensional target shape of the excavation object. The three-dimensional data includes the three-dimensional coordinate data of each of a plurality of points on the surface of the target excavation landform.

The arithmetic processor 40C includes a vehicle state data acquisition unit 43, a working equipment state data acquisition unit 44, a target excavation landform data acquisition unit 45, a calculator 46, and a display controller 47.

The vehicle state data acquisition unit 43 acquires vehicle state data indicating the position and posture of the swing body 3 from the position detector 20. The position of the swing body 3 is the position Pg in the global coordinate system. The posture of the swing body 3 is represented by the roll angle θ5, the pitch angle θ6, and the azimuth angle θ7. The position calculator 23 detects a position Pg of the swing body 3 in the global coordinate system. The posture calculator 24 detects the posture of the swing body 3, which includes the roll angle θ5, the pitch angle θ6, and the azimuth angle θ7. The vehicle state data acquisition unit 43 acquires vehicle state data the position Pg of the swing body 3 in the global coordinate system and the posture of the swing body 3, which includes the roll angle θ5, the pitch angle θ6, and the azimuth angle θ7.

The working equipment state data acquisition unit 44 acquires working equipment state data indicating the posture of the working equipment 2. The posture of the working equipment 2 is represented by the tilt angle θ1 of the boom 6 relative to the Zm-axis of the vehicle body coordinate system, the tilt angle θ2 of the arm 7 relative to the boom 6, the tilt angle θ3 of the blade edge 9T of the bucket 9 relative to the arm 7, and the tilt angle θ4 of the bucket 9 relative to the axis AXZ. In the above manner, with the tilt angle calculator of the working equipment angle detector 19, the tilt angles θ1, θ2, θ3, and θ4 are calculated. The working equipment state data acquisition unit 44 acquires working equipment state data including the tilt angle of the working equipment 2 from the working equipment angle detector 19.

The target excavation landform data acquisition unit 45 acquires target excavation landform data indicating the target excavation landform of the excavation object from the target excavation landform data storage unit 42.

Figure 8:
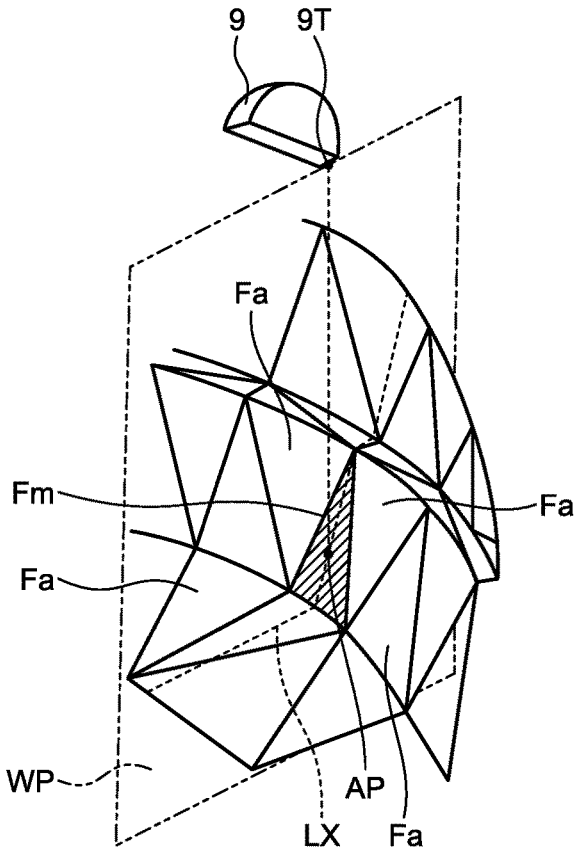
FIG. 8 is a view schematically illustrating an example of a target excavation landform according to the present embodiment.

FIG. 8 is a view schematically illustrating an example of a target excavation landform according to the present embodiment. As illustrated in FIG. 8, the target excavation landform data includes a plurality of design planes Fa represented by triangular polygons. One or a plurality of design planes Fa are selected as a target plane Fm from the plurality of design planes Fa. The target plane Fm indicates a target shape of the excavation object plane to be excavated by the bucket 9. The target excavation landform data acquisition unit 45 defines an operation plane WP passing through the blade edge 9T of the bucket 9 and orthogonal to the rotation axis AX3. The working equipment state data acquisition unit 44 calculates the position of the blade edge 9T of the bucket 9. The target excavation landform data acquisition unit 45 also defines a point AP on the target plane Fm, whose vertical distance from the bucket 8 through the operation plane WP is shortest. In addition, the target excavation landform data acquisition unit 45 calculates an intersection line LX between the operation plane WP and the design plane Fa including the target plane Fm. The operation plane WP is a plane where the blade edge 9T of the bucket 9 is moved by at least one of the actuations of the boom cylinder 10, the arm cylinder 11, and the bucket cylinder 12 and is parallel to a ZmXm plane.

The calculator 46 acquires vehicle state data from the vehicle state data acquisition unit 43, working equipment outer shape data from the working equipment outer shape data storage unit 41, and working equipment state data from the working equipment state data acquisition unit 44. The calculator 46 calculates a reference vector B extending in the widthwise direction of the bucket 9 of the working equipment 2 and passing through a specified portion of the bucket 9 on the basis of the vehicle state data, the working equipment outer shape data, and the working equipment state data.

In this present embodiment, the specified portion of the bucket 9 is the blade edge 9T of the bucket 9. The reference vector B is defined so as to pass through the blade edge 9T of the bucket 9. In the following description, the reference vector B will be referred as the blade edge vector B as needed.

Figure 9:
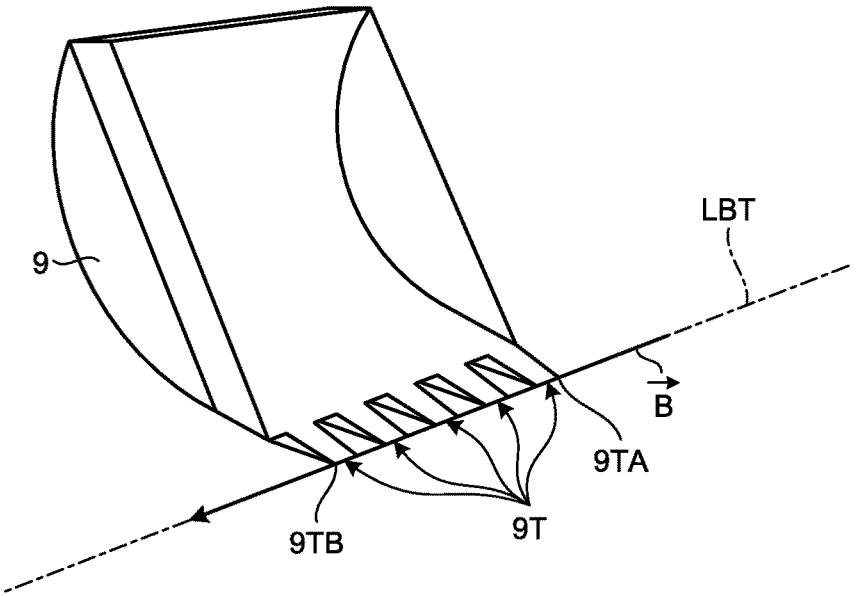
FIG. 9 is a view for explaining a blade edge vector according to the present embodiment.

FIG. 9 is a view for explaining the blade edge vector B according to the present embodiment. As illustrated in FIG. 9, the blade edge vector B extends in the widthwise direction of the bucket 9. The widthwise direction of the bucket 9 is a direction parallel to the blade edge line LBT. The blade edge vector B is orthogonal to an axis parallel to the tilt rotation axis AX4.

The blade edge vector B passes through the plurality of blade edges 9T of the bucket 9 which are arrayed in the widthwise direction of the bucket 9. The blade edge vector B is parallel to the blade edge line LBT of the bucket 9. The blade edge vector B is calculated on the basis of the vehicle state data acquired by the vehicle state data acquisition unit 43, the working equipment state data acquired by the working equipment state data acquisition unit 44, and the working equipment outer shape data stored in the working equipment data storage unit 41.

The calculator 46 can calculate the position of each of a plurality of points on the bucket 9 relative to a reference point on the swing body 3 in the vehicle body coordinate system on the basis of the working equipment state data acquired by the working equipment state data acquisition unit 44 and including the tilt angle θ1, the tilt angle θ2, the tilt angle θ3, and the tilt angle θ4, and the working equipment outer shape data stored in the working equipment outer shape data storage unit 41 and including the length L1 of the boom 6, the length L2 of the arm 7, the length L3 of the coupling member 8, the length L4 of the bucket 9, and the width W of the bucket 9. The reference point on the swing body 3 is set on the swing axis Zr of the swing body 3. Note that the reference point on the swing body 3 may be set on the rotation axis AX1. The calculator 46 can calculate the posture of the bucket 9 in the vehicle body coordinate system on the basis of the position of each of a plurality of points on the bucket 9 in the vehicle body coordinate system.

The calculator 46 calculates a position PA of a blade edge 9TA, of a plurality of points on the bucket 9, which is located at one end in the widthwise direction of the bucket 9 and a position PB of a blade edge 9TB located at the other end. The calculator 46 also calculates the blade edge vector B by connecting the calculated blade edge 9TA and blade edge 9TB.

An example of a method of calculating the blade edge vector B will be described below. The calculator 46 calculates the coordinates (xt, yt, zt) of a position Pt of the tilt rotation axis AX4 in the vehicle body coordinate system on the basis of the lengths L1, L2, and L3 and the tilt angles θ1, θ2, and θ3.

The calculator 46 calculates the position PA and the position PB in the vehicle body coordinate system on the basis of the tilt angle θ4, the length L4 of the bucket 9 stored in the working equipment outer shape data storage unit 41, and the width W of the bucket 9 stored in the working equipment outer shape data storage unit 41. The width W is the distance between the blade edge 9TA and the blade edge 9TB. The coordinates (xmA, ymA, zmA) of the position PA are calculated on the basis of equations (1), (2), and (3). The coordinates (xmB, ymB, zmB) of the position PB are calculated on the basis of equations (4), (5), and (6).

$$xmA = \left\{L4 \times \sin(\pi - \theta 4) + \frac{W}{2} \times \cos(\pi - \theta 4)\right\} \times \sin(\theta 1 + \theta 2 + \theta 3 - \pi) \quad (1)$$

-continued $$ymA = L4 \times \cos(\pi - \theta 4) - \frac{W}{2} \times \sin(\pi - \theta 4) \quad (2)$$

$$zmA = \left\{L4 \times \sin(\pi - \theta 4) + \frac{W}{2} \times \cos(\pi - \theta 4)\right\} \times \cos(\theta 1 + \theta 2 + \theta 3 - \pi) \quad (3)$$

$$xmB = \left\{L4/\sin(\pi - \theta 4) - \frac{W}{2} \times \cos(\pi - \theta 4)\right\} \times \sin(\theta 1 + \theta 2 + \theta 3 - \pi) \quad (4)$$

$$ymB = L4 \times \cos(\pi - \theta 4) + \frac{W}{2} \times \sin(\pi - \theta 4) \quad (5)$$

$$zmB = \left\{L4/\sin(\pi - \theta 4) - \frac{W}{2} \times \cos(\pi \theta 4)\right\} \times \cos(\theta 1 + \theta 2 + \theta 3 - \pi) \quad (6)$$

The coordinates (xmtA, ymtA, zmtA) of the position PA of the blade edge 9TA in the vehicle body coordinate system with reference to the coordinates (xt, yt, zt) of the position Pt of the tilt rotation axis AX4 are calculated on the basis of equations (7), (8), and (9). The coordinates (xmtB, ymtB, zmtB) of the position PB of the blade edge 9TA in the vehicle body coordinate system with reference to the coordinates (xt, yt, zt) of the position Pt of the tilt rotation axis AX4 are calculated on the basis of equations (10), (11), and (12).

$$xmtA = xt - xmA \quad (7)$$

$$ymtA = yt - ymA \quad (8)$$

$$zmtA = zt - zmA \quad (9)$$

$$xmtB = xt - xmB \quad (10)$$

$$ymtB = yt - ymB \quad (11)$$

$$zmtB = zt - zmB \quad (12)$$

The calculator 46 can calculate the blade edge vector B on the basis of the coordinates (xmtA, ymtA, zmtA) of the blade edge 9TA and the coordinates (xmtB, ymtB, zmtB) of the blade edge 9TB.

The calculator 46 can also calculate the position of each of a plurality of points on the bucket 9 in the global coordinate system on the basis of the position Pg of the swing body 3 detected by the position detector 20 and the relative position between the reference point on the swing body 3 and each of the plurality of points on the bucket 9. The relative position between the position Pg and the reference point on the swing body 3 is known data derived from the specification data of the excavator 1. The calculator 46 can calculate the position of each of the plurality of points on the bucket 9 in the global coordinate system on the basis of the position Pg of the swing body 3, the relative position between the reference point on the swing body 3 and each of the plurality of points on the bucket 9, working equipment data, and the tilt angles (θ1, θ2, θ3, θ4) of the working equipment 2. The calculator 46 can calculate the posture of the bucket 9 in the global coordinate system on the basis of the position of each of the plurality of points on the bucket 9 in the global coordinate system.

The calculator 46 also generates display data displayed on the display device 34. The calculator 46 generates display data including an image illustrating the relative position between the bucket 9 and at least part of the target excavation landform. The calculator 46 generates an image illustrating the bucket 9 viewed from a direction orthogonal to the blade edge vector B and an image illustrating a target line Lr being at least part of the target excavation landform on the basis of the blade edge vector B and the target excavation landform. The calculator 46 generates an image illustrating the relative position between the target line Lr and the bucket 9 viewed from a direction orthogonal to the blade edge vector B. The target line Lr is defined by an intersection line between the target plane Fm and a plane including the blade edge vector B and orthogonal to the target plane Fm on the target excavation landform of the excavation object. The calculator 46 outputs the generated images to the display controller 47.

The display controller 47 causes the display device 34 to display the display data generated by the calculator 46. The display controller 47 causes the display device 34 to display the display data including the bucket 9 and the target line Lr. The display controller 47 causes the display device 34 to display the bucket 9 viewed from a direction orthogonal to the blade edge vector B and the target line Lr. The display controller 47 causes the display device 34 to display the image illustrating the relative position between the target line Lr and the bucket 9 viewed from a direction orthogonal to the blade edge vector B.

The display device 34 displays a guide screen 50 for assisting the operation of the operating device 30 by the operator. The guide screen 50 includes an image illustrating the relative position between the bucket 9 and the target plane Fm and the relative value between the target line Lr and the bucket 9 viewed from a direction orthogonal to the blade edge vector B. The target line Lr will be described later.

[Guide Screen]

Figure 10:
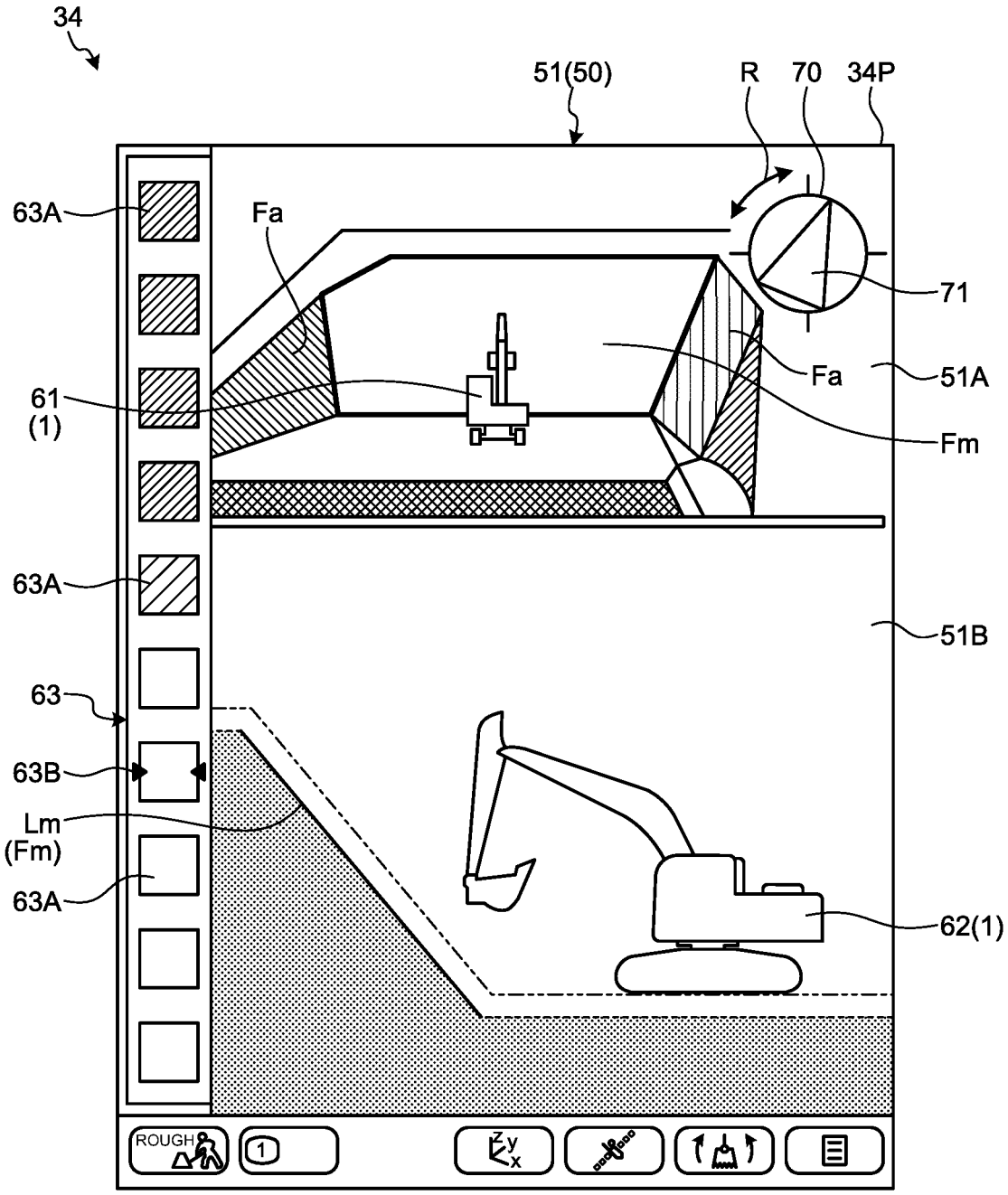
FIG. 10 is a view illustrating an example of a guide screen according to the present embodiment.
Figure 11:
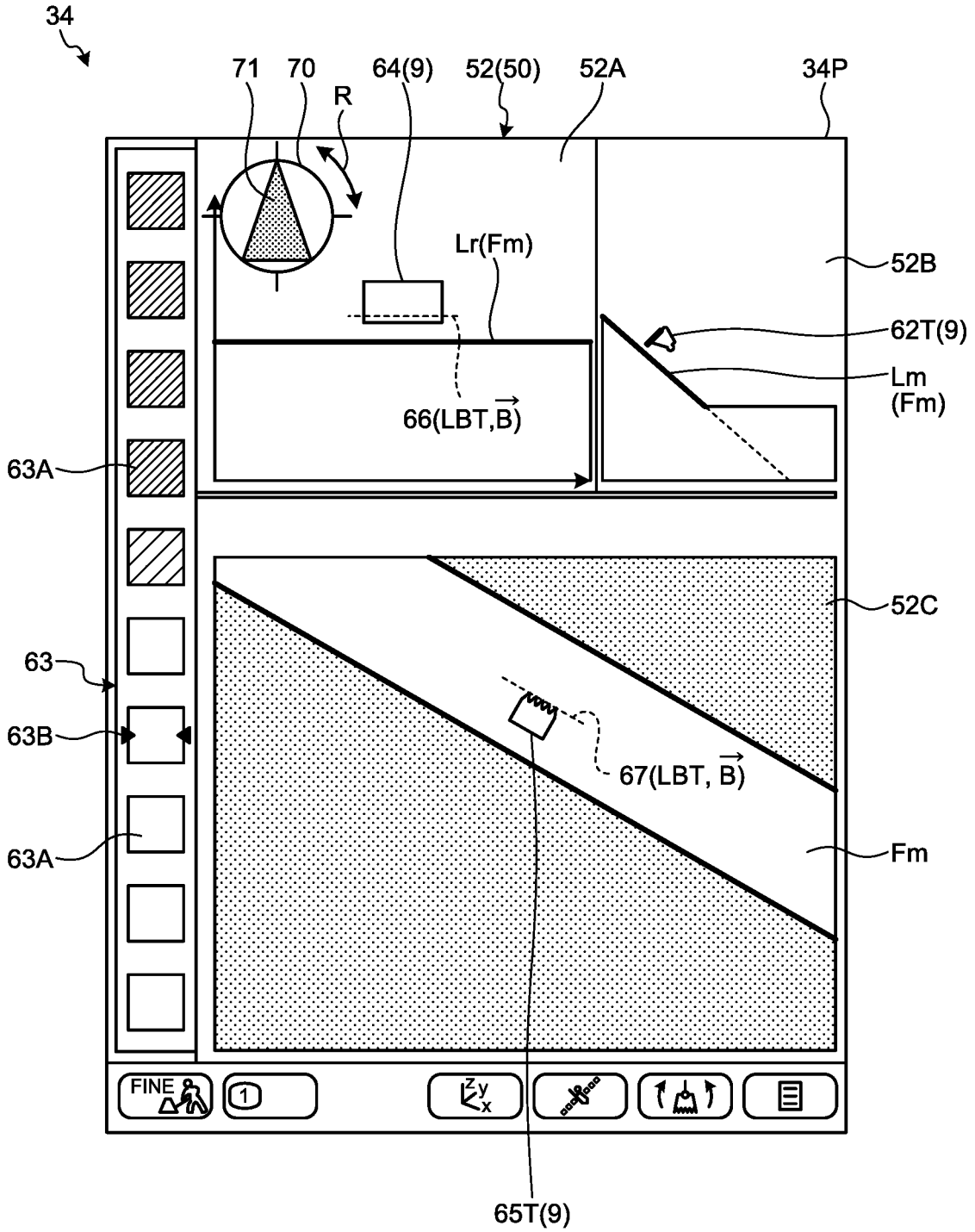
FIG. 11 is a view illustrating an example of a guide screen according to the present embodiment.

FIGS. 10 and 11 are views each illustrating an example of the guide screen 50 according to the present embodiment. The guide screen 50 is a screen that displays the relative position between the blade edge 9T of the bucket 9 and the target plane Fm to guide the operation of the operating device 30 by the operator of the excavator 1 so as to excavate the excavation object in accordance with the target plane Fm. In the present embodiment, the guide screen 50 includes a coarse excavation screen 51 for a coarse excavation mode illustrated in FIG. 10 and a fine excavation screen 52 for a fine excavation mode illustrated in FIG. 11. The guide screen 50 is displayed on a screen 34P of the display device 34. The fine excavation screen 52 is a screen more precisely illustrating the relative position between the blade edge 9T of the bucket 9 and the target plane Fm than the coarse excavation screen 51. A transition can be made between the coarse excavation screen 51 and the fine excavation screen 52 by pressing down a button on the lower left of each scene.

As illustrated in FIG. 10, the coarse excavation screen 51 includes a front view 51A illustrating the relative position between the excavator 1, the target plane Fm, and the design plane Fa, and a side view 51B illustrating the relative position between the excavator 1 and the target plane Fm.

The front view 51A displays an image when the excavator 1 and the target excavation landform are viewed from the front. The front view 51A is an image within a plane orthogonal to the Xm-axis of the vehicle body coordinate system. The front view 51A displays an image illustrating the relative position between the excavator 1 and the target plane Fm.

The display controller 47 causes the display device 34 to display the design plane Fa including the target plane Fm expressed by a plurality of triangular polygons. In the case illustrated in FIG. 11, the target excavation landform is a normal plane, and the excavator 1 faces the normal plane. In addition, the target plane Fm selected from the plurality of design planes Fa is displayed in a color different from that of the remaining design planes Fa.

The front view 51A also displays an icon 61 indicating the position of the excavator 1. The icon 61 is an image imitating the outer shape of the excavator 1. In the case illustrated in FIG. 10, the icon 61 is displayed, which imitates the outer shape of the excavator 1 when the excavator 1 is viewed from the back.

The front view 51A displays an image in the vehicle body coordinate system. When, for example, the excavator 1 tilts, the design plane Fa including the target plane Fm in the front view 51A also tilts. Note that the front view 51A can also display an image in the global coordinate system.

Note that the front view 51A may not display the icon 61 imitating the outer shape of the excavator 1 as long as the front view 51A displays an image illustrating the position of the blade edge 9T of the bucket 9.

The display controller 47 causes the display device 34 to display guide display data 70 for making the blade edge vector B (blade edge line LBT) of the bucket 9 directly face the target line Lr (target plane Fm) of the target excavation landform. In the present embodiment, the guide display data 70 is an indicator including an image of an arrow-shaped guide 71. In the following description, the guide display data 70 will be referred to as the facing compass 70 as needed.

A state in which the blade edge 9T of the bucket 9 directly faces the target plane Fm corresponds to a state in which the blade edge line LBT faces the target plane Fm. That is, this state includes a state in which the blade edge vector B is orthogonal to a normal vector N of the target plane Fm, and includes an angular error within a predetermined range relative to a state in which the blade edge vector B is orthogonal to the vector N.

FIG. 10 illustrates a state in which the blade edge line LBT of the bucket 9 does not directly face the target plane Fm.

The side view 51B displays an image when the excavator 1 and the target excavation landform are viewed from a side. The side view 51B displays an image within a plane orthogonal to the Ym-axis of the vehicle body coordinate system. The side view 51B displays an image illustrating the relative position between the blade edge 9T of the bucket 9 and the target plane Fm. The relative position between the blade edge 9T of the bucket 9 and the target plane Fm includes the distance between the blade edge 9T of the bucket 9 and the target plane Fm.

The side view 51B displays a target line Lm and an icon 62 indicating the position of the excavator 1. The icon 62 is image data imitating the outer shape of the excavator 1. In the case illustrated in FIG. 9, the icon 62 is displayed, which imitates the outer shape of the excavator 1 when the excavator 1 is viewed from a side.

The target line Lm indicates a cross-section of the target plane Fm. The display controller 47 calculates the target line Lm on the basis of the intersection line LX between the operation plane WP and the target plane Fm. As described above, the operation plane WP is a plane where the blade edge 9T of the bucket 9 is moved by at least one of the actuations of the boom cylinder 10, the arm cylinder 11, and the bucket cylinder 12, and is parallel to an XmZm plane.

The distance between the blade edge 9T of the bucket 9 and the target plane Fm is the distance between the blade edge 9T and an intersection point between the target plane Fm and a line passing through the blade edge 9T and orthogonal to the target plane Fm. Note that the distance between the blade edge 9T of the bucket 9 and the target plane Fm may be the distance between the blade edge 9T and an intersection point between the target plane Fm and a line that passes through the blade edge 9T and is parallel to the Zg-axis.

The distance between the blade edge 9T of the bucket 9 and the target plane Fm is displayed by a graphic 63. As illustrated in FIG. 10, the graphic 63 includes a plurality of index bars 63A indicating the position of the blade edge 9T of the bucket 9 and an index mark 63B indicating the position of the blade edge 9T of the bucket 9 when the distance between the blade edge 9T of the bucket 9 and the target plane Fm becomes zero.

Note that the side view 51B may display image data indicating the position of the excavator 1 instead of the icon 62 imitating the outer shape of the excavator 1.

Note that the distance between the blade edge 9T of the bucket 9 and the target plane Fm may be displayed in characters or numbers.

As illustrated in FIG. 11, the fine excavation screen 52 includes a front view 52A illustrating the relative position between the bucket 9 and the target plane Fm, a side view 52B illustrating the relative position between the bucket 9 and the target plane Fm, and a plan view 52C illustrating the relative position between the bucket 9 and the target plane Fm.

The front view 52A displays an image when the bucket 9 and the target plane Fm are viewed from the front. The front view 52A displays an image within a plane parallel to the coupling member 8. The front view 52A displays an image illustrating the relative position of the blade edge 9T of the bucket 9 and the target plane Fm.

The front view 52A displays the facing compass 70, the target line Lr, an icon 64 indicating the position of the bucket 9, and a line image 66 illustrating the position of the blade edge line LBT (blade edge vector B). The line image 66 is an image illustrating the position of the blade edge 9T of the bucket 9. Although the front view 52A is described as an embodiment on the fine excavation screen, the front view 52A may be set to be displayed on the coarse excavation screen. In addition, settings can be made to arbitrarily determine whether to display the front view 52A, the side view 52B, and the plan view 52C on screens and the sizes of displays.

FIG. 11 illustrates an image in which the blade edge line LBT of the bucket 9 becomes parallel to the target plane Fm.

The icon 64 is an image imitating the outer shape of the bucket 9. The display controller 47 causes the display device 34 to display the icon 64 illustrating the bucket 9 viewed from a direction orthogonal to the blade edge vector B. In the present embodiment, the display controller 47 causes the display device 34 to display the icon 64 indicating the bucket 9 viewed from a direction orthogonal to each of the blade edge vector B and the tilt rotation axis AX4. That is, the display controller 47 causes the display device 34 to display an image within a plane parallel to the coupling member 8 and orthogonal to the tilt rotation axis AX4.

In the case illustrated in FIG. 11, the icon 64 is displayed, which imitates the outer shape of the bucket 9 viewed from a direction which is orthogonal to the blade edge vector B and from which the outer shape of the bucket 9 can be seen.

The target line Lr indicates the shape of at least part of the target excavation landform and a cross-section of the target plane Fm of the target excavation landform. The target line Lr indicates a shape at a cross-section including the blade edge vector B (blade edge line LBT) and orthogonal to the target plane Fm. The target line Lr is defined by an intersection line between the target plane Fm and the plane including the blade edge vector B and orthogonal to the target plane Fm. That is, the target line Lr indicates a cross-section of the target plane Fm of the target excavation landform when the target plane Fm is viewed from a direction orthogonal to the blade edge vector B.

In the following description, viewing from a direction orthogonal to the blade edge vector B as illustrated in the front view 52A will be referred to as bucket front viewing as needed. That is, bucket front viewing means viewing with a line of sight orthogonal to the blade edge vector B.

The front view 52A displays the icon 64 as an image illustrating the bucket 9 in bucket front viewing, the line image 66 illustrating the blade edge line LBT of the bucket 9, and an image illustrating the target line Lr.

FIG. 11 illustrates the state of the blade edge line LBT of the bucket 9 and the target plane Fm. The front view 52A displays a state in which the line image 66 becomes parallel to the target line Lr.

The side view 52B displays an image of the excavator 1 and the target excavation landform viewed from a side. The side view 52B displays an image within a plane orthogonal to the Ym-axis of the vehicle body coordinate system. The side view 52B displays an image illustrating the relative position between the blade edge 9T of the bucket 9 and the target plane Fm. The side view 52B displays the icon 62 indicating the position of the working equipment 2 and the target line Lm.

The plan view 52C displays an image of the bucket 9 and the target excavation landform viewed from above. The plan view 52C displays an image within a plane orthogonal to the Zm-axis of the vehicle body coordinate system. FIG. 52C displays an image illustrating the relative position between the bucket 9 and the target plane Fm. FIG. 52C displays an icon 65T indicating the position of the bucket 9 and a line image 67 indicating the position of the blade edge line LBT. The icon 65T is image data imitating the outer shape of the bucket 9. In the case illustrated in FIG. 11, the icon 65T is displayed, which imitates the outer shape of the bucket 9 when the bucket 9 is viewed from above. In addition, the target plane Fm selected from the plurality of design planes Fa is displayed in a color different from that of the remaining design planes Fa.

[Image in Bucket Front Viewing and Image in Operator Front Viewing]

Figure 12:
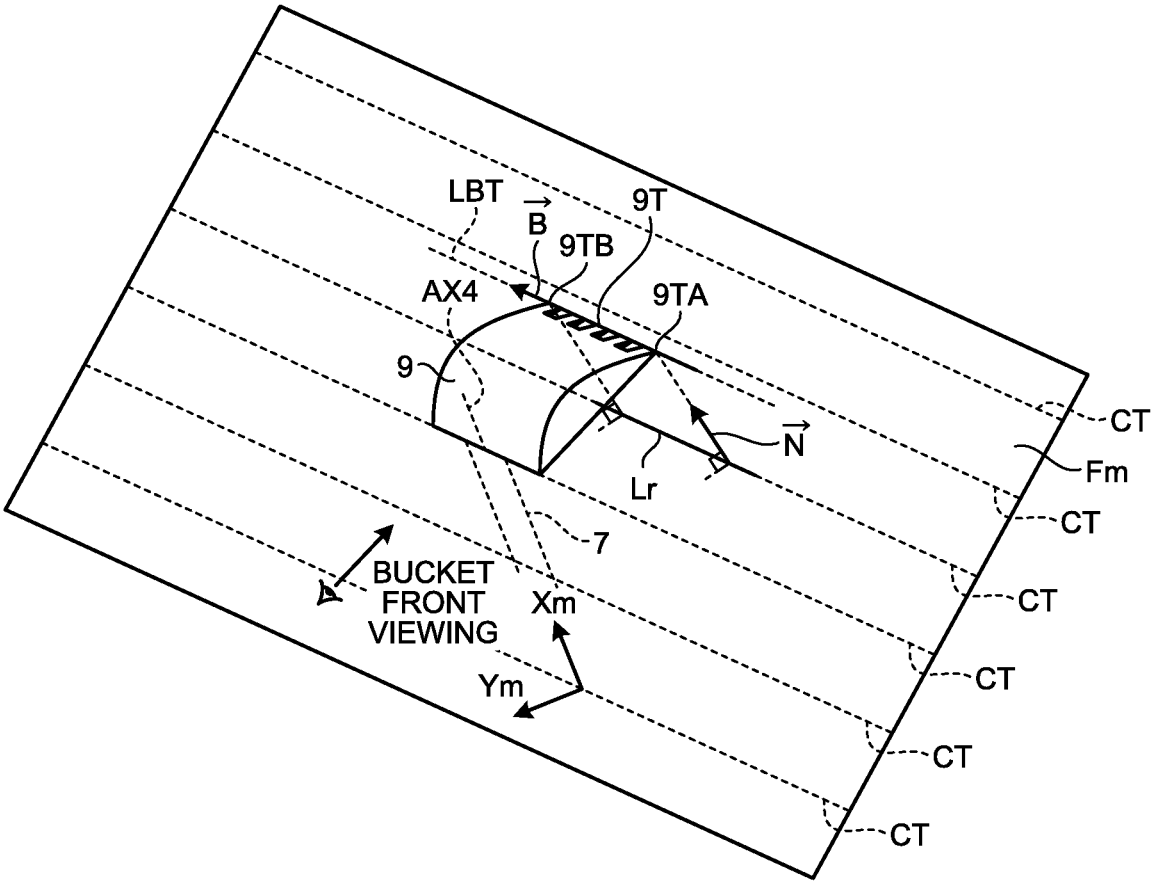
FIG. 12 is a view for explaining a method of deriving a target line in a bucket front view according to the present embodiment.

FIG. 12 is a view for explaining a method of deriving the target line Lr in bucket front viewing according to the present embodiment. FIG. 12 illustrates a state in which the blade edge line LBT is parallel to the target plane Fm. In addition, the target plane Fm is a normal plane (inclined plane). Referring to FIG. 12, contour lines CT are added to the target plane Fm to clarify the inclined direction of the target plane Fm.

As illustrated in FIG. 12, the target line Lr is defined by an intersection line between the reference plane Fm and a plane passing through the blade edge line LBT (reference vector B) and orthogonal to the reference plane Fm.

An image in bucket front viewing is an image viewed from a direction orthogonal to each of the reference vector B and the Zm-axis of the vehicle body coordinate system. As the bucket 9 tilts and rotates, the viewpoint in bucket front viewing swings about the tilt rotation axis AX4 in synchronism with the tilt rotation.

As illustrated in FIG. 12, even in a state in which the Ym-axis of the vehicle body coordinate system is not parallel to the blade edge line LBT, the operator can make the blade edge line LBT parallel to the target line Lr on the target plane Fm by operating the operating device 30 so as to make the bucket 9 tilt and rotate. In this case, that the blade edge line LBT is parallel to the target line Lr means that the distance between the blade edge 9TA on the blade edge line LBT and the target line Lr is equal to the distance between the blade edge 9TB on the blade edge line LBT and the target line Lr.

Figure 13:
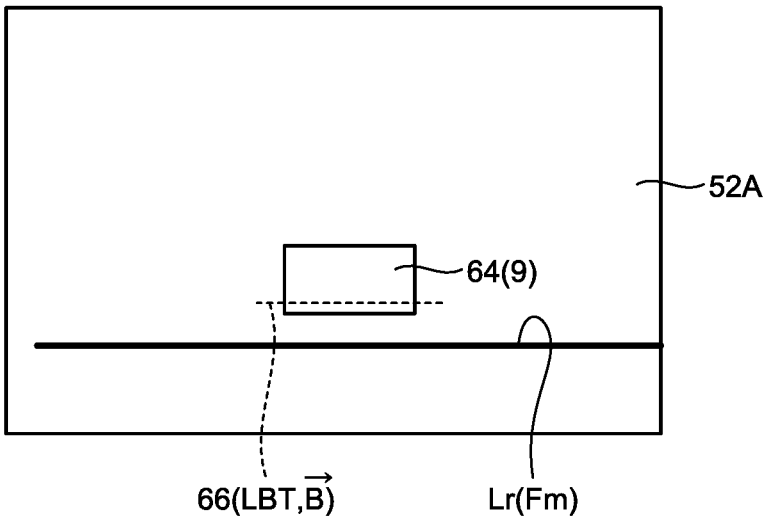
FIG. 13 is a view for explaining an image illustrating each of the bucket and a target excavation landform in a bucket front view according to the present embodiment.

FIG. 13 is a view for explaining an image illustrating each of the bucket 9 and the target excavation landform in bucket front viewing according to the present embodiment. FIG. 13 corresponds to the front view 52A illustrated in FIG. 11. FIG. 13 illustrates an image in bucket front viewing when the blade edge line LBT is parallel to the target line Lr as described with reference to FIG. 12.

As illustrated in FIG. 12, when the bucket 9 tilts and rotates, the blade edge line LBT can be made parallel to the target line Lr from a state in which the Ym-axis of the vehicle body coordinate system is not parallel to the blade edge line LBT. At this time, as illustrated in FIG. 13, an image in bucket front viewing displays a state in which the line image 66 illustrating the blade edge line LBT is parallel to the target line Lr.

As illustrated in FIG. 13, when the relative relationship between the blade edge line LBT and the target line Lr is displayed on the basis of the actual operation of the bucket 9, the operator can recognize that the blade edge line LBT becomes parallel to the target line Lr.

Figure 14:
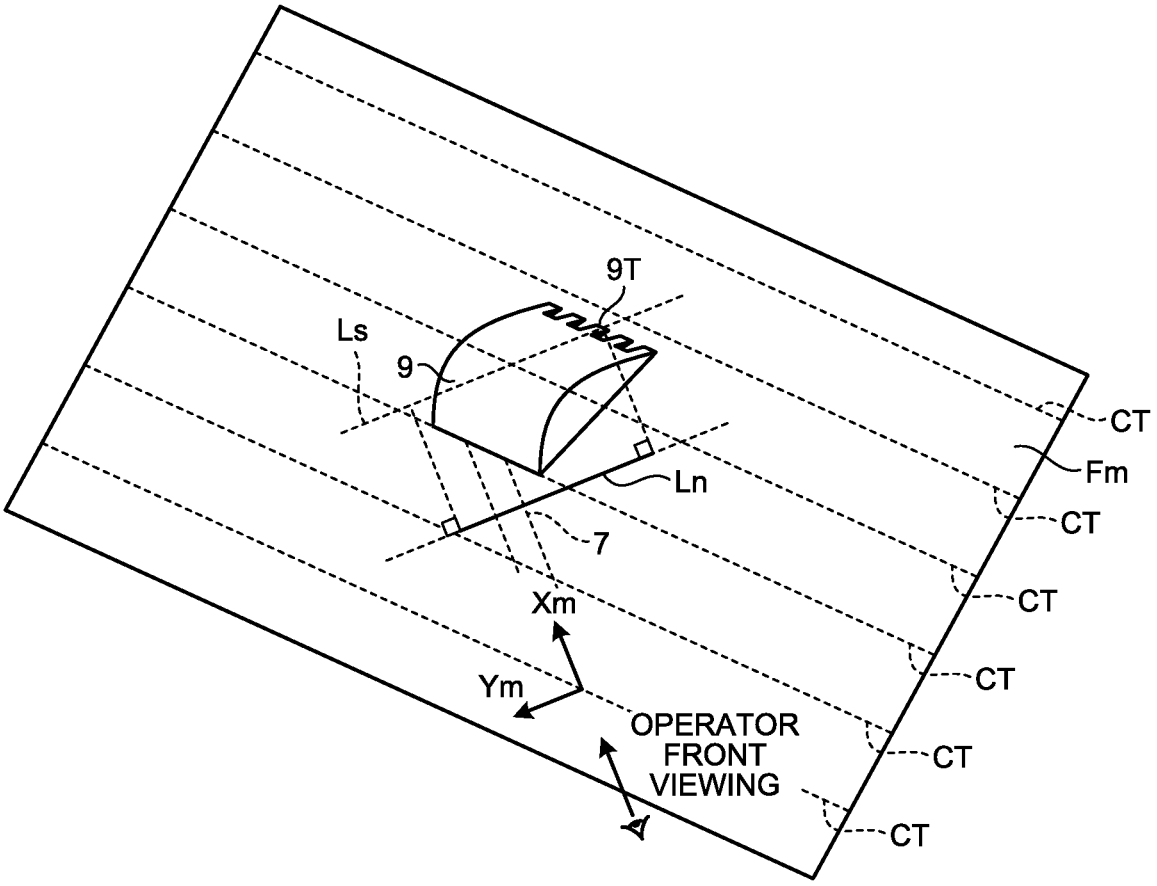
FIG. 14 is a view for explaining a target line in an operator front view.

FIG. 14 is a view for explaining the target line Ln in operator front viewing. Like FIG. 12, FIG. 14 illustrates a state in which the blade edge line LBT is parallel to the target plane Fm. In addition, the target plane Fm is a normal plane (inclined plane).

Operator front viewing means viewing from a direction orthogonal to the Ym-axis of the vehicle body coordinate system. That is, operator front viewing means viewing with a line of sight parallel to the Xm-axis with the viewpoint being located in the operating room 4. An image in operator front viewing is an image viewed from a direction orthogonal to the Ym-axis of the vehicle body coordinate system. That is, an image in operator front viewing is an image within a plane parallel to the Xm-axis of the vehicle body coordinate system.

As illustrated in FIG. 14, the target line Ln in operator front viewing is defined by an intersection line between the reference plane Fm and a plane passing through a line LS parallel to the Ym-axis in the vehicle body coordinate system and orthogonal to the reference plane Fm. The line LS passes through the blade edge 9T.

As illustrated in FIG. 14, even in a state in which the Ym-axis of the vehicle body coordinate system is not parallel to the blade edge line LBT, the operator can make the blade edge line LBT parallel to the target plane Fm by operating the operating device 30 so as to tilt and rotate the bucket 9.

Figure 15:
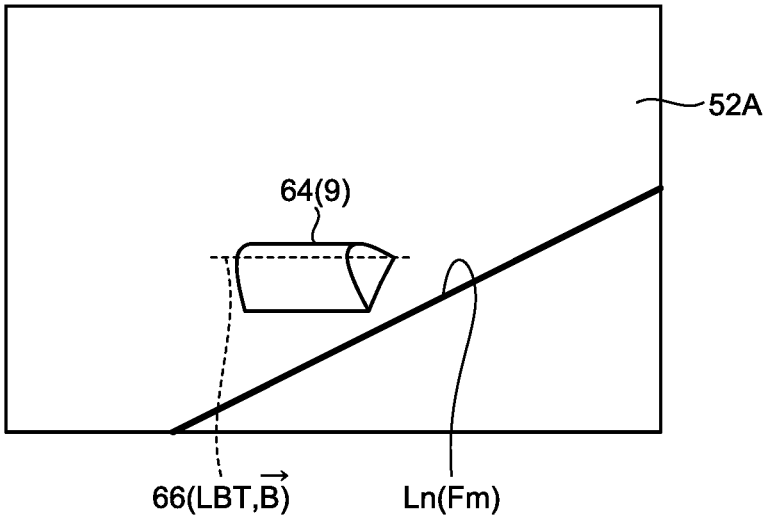
FIG. 15 is a view for explaining an image illustrating each of the bucket and a target excavation landform in an operator front view.

FIG. 15 is a view for explaining an image illustrating each of the bucket 9 and the target excavation landform in operator front viewing. FIG. 15 is a view in bucket front viewing when the blade edge line LBT is parallel to the target plane Fm like those described with reference to FIG. 14.

As illustrated in FIG. 14, even in a state in which the Ym-axis of the vehicle body coordinate system is not parallel to the blade edge line LBT, when the bucket 9 tilts and rotates, the blade edge line LBT becomes parallel to the target plane Fm. As illustrated in FIG. 15, an image in operator front viewing displays a state in which the target line Lr tilts relative to the line image 66 illustrating the blade edge line LBT.

That is, in a state in which the actual blade edge line LBT of the bucket 9 is parallel to the target plane Fm, the line image 66 and a target line Fr on an image in operator front viewing cannot indicate that the blade edge line LBT is parallel to the target plane Fm but indicate that the target plane Fm tilts relative to the blade edge line LBT.

For example, the reason why the target line Ln is displayed so as to tilt relative to the line image 66 in an image in operator front viewing although the actual blade edge line LBT of the bucket 9 is parallel to the target plane Fm is that the image in operator front viewing is an image within a plane passing through the line LS parallel to the Ym-axis of the vehicle body coordinate system.

As illustrated in FIG. 15, the line image 66 and the target line Ln in the image in operator front viewing do not accurately indicate that the blade edge line LBT is parallel to the target plane Fm. This makes the operator feel uncomfortable about the image displayed on the display device 34 or may fail to sufficiently assist the operator to operate the operating device 35.

According to the present embodiment, an image in bucket front viewing is displayed on the display device 34. The image in bucket front viewing is an image viewed from a direction orthogonal to the blade edge vector B. Accordingly, as described with reference to FIG. 13, when the actual blade edge line LBT of the bucket 9 is parallel to the target plane Fm, the line image 66 and the target line Lr on an image in bucket front viewing can also indicate that the blade edge line LBT is parallel to the target plane Fm. This prevents the operator from feeling uncomfortable about the image displayed on the display device 34 and operation of the operating device 35 by the operator is sufficiently assisted.

Figure 16:
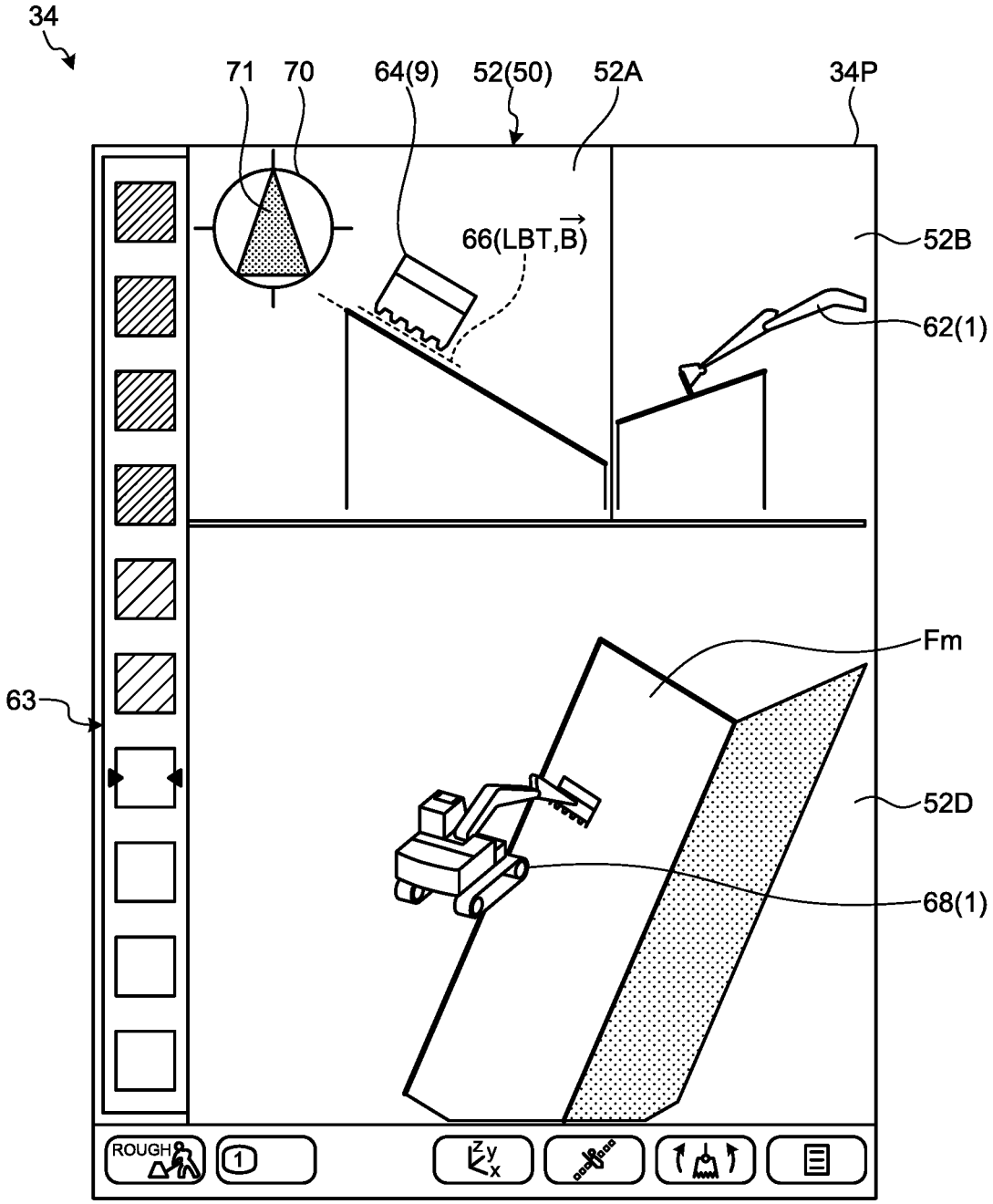
FIG. 16 is a view illustrating a guide screen according to the present embodiment.

FIG. 16 is a view illustrating an example of the fine excavation screen 52 according to the present embodiment. FIG. 16 explains a case in which the target line Lr is parallel to a horizontal plane. FIG. 16 illustrates a case in which the target line Lr tilts relative to a horizontal plane.

Referring to FIG. 16, the fine excavation screen 52 includes the front view 52A displaying an image in bucket front viewing, the side view 52B, and a bird's eye view 52D in which the excavator 1 and the target plane Fm are viewed obliquely from above. The bird's eye view 52D displays an icon 68 indicating the position of the excavator 1. The target plane Fm is an inclined plane existing below the traveling device 5 of the excavator 1. The traveling device 5 is positioned on the horizontal ground around the target plane Fm.

The operator can make the blade edge line LBT parallel to the target plane Fm by operating the operating device 30 so as to make the bucket 9 tilt and rotate. Even in a state in which the Ym-axis of the vehicle body coordinate system is not parallel to the blade edge line LBT, when the bucket 9 tilts and rotates, the blade edge line LBT becomes parallel to the target plane Fm. As illustrated in the front view 52A in FIG. 16, an image in bucket front viewing displays the line image 66 parallel to the target line Lr. Note that in the case illustrated in FIG. 16, because the target line Lr tilts relative to a horizontal plane, the line image 66 illustrating the blade edge line LBT is also displayed in an inclined state.

In the case illustrated in FIG. 16 as well, when the actual blade edge line LBT of the bucket 9 is parallel to the target plane Fm, the line image 66 and the target line Lr on an image in bucket front viewing can indicate that the blade edge line LBT is parallel to the target plane Fm.

[Display Method]

Figure 17:
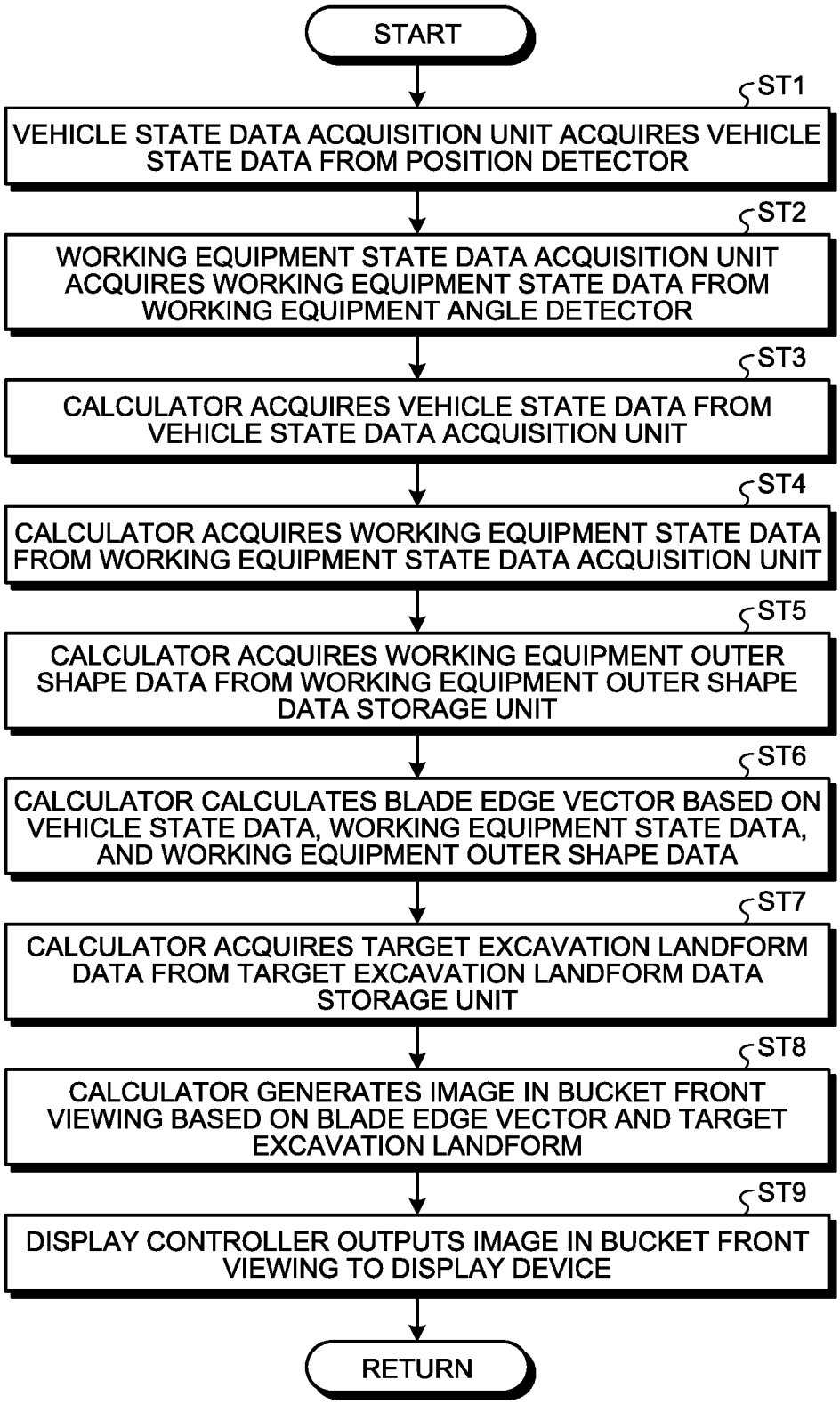
FIG. 17 is a flowchart illustrating an example of a display method according to the present embodiment.

A display method according to the present embodiment will be described next. FIG. 17 is a flowchart illustrating an example of the display method according to the present embodiment.

The position detector 20 outputs detected vehicle state data to the vehicle state data acquisition unit 43. The working equipment angle detector 19 outputs the calculated working equipment state data to the working equipment state data acquisition unit 44. The vehicle state data acquisition unit 43 acquires vehicle state data from the position detector 20 (step ST1). The working equipment state data acquisition unit 44 acquires working equipment state data from the working equipment angle detector 19 (step ST2). Note that the execution order of steps ST1 and ST2 may be inverted or steps ST1 and ST2 may be simultaneously executed.

The vehicle state data acquisition unit 43 outputs the acquired vehicle state data to the calculator 46. The working equipment state data acquisition unit 44 also outputs the acquired working equipment state data to the calculator 46. The calculator 46 acquires vehicle state data from the vehicle state data acquisition unit 43 (step ST3). The calculator 46 also acquires working equipment state data from the working equipment state data acquisition unit 44 (step ST4). The calculator 46 acquires working equipment outer shape data from the working equipment outer shape data storage unit 41 (step ST5). Note that the execution order of steps ST3, ST4, and ST5 is arbitrary and steps ST3, ST4, and ST5 may be simultaneously executed.

The calculator 46 calculates the blade edge vector B on the basis of the vehicle state data, the working equipment outer shape data, and the working equipment state data (step ST6).

The calculator 46 also acquires target excavation landform data from the target excavation landform data storage unit 42 (step ST7).

The calculator 46 generates an image illustrating the relative position between the target plane Fm and the bucket 9 viewed from a direction orthogonal to the blade edge vector B, that is, an image in bucket front viewing, on the basis of the calculated reference vector B and the acquired target excavation landform (step ST8). That is, the calculator 46 generates the icon 64 as an image illustrating the bucket 9 in bucket front viewing and the target line Lr as an image illustrating a cross-section of the surface of the reference plane Fm of the target excavation landform.

The calculator 46 outputs the generated image in bucket front viewing to the display controller 47. The display controller 47 acquires the image in bucket front viewing from the calculator 46. The display controller 47 outputs an image illustrating the relative position between the target plane Fm and the bucket 9 viewed from a direction orthogonal to the reference vector B, that is, an image in bucket front viewing, to the display device 34 (step ST9). That is, the display controller 47 causes the display device 34 to display the icon 64 as an image illustrating the bucket 9 in bucket front viewing and the target line Lr as an image illustrating a cross-section of the surface of the reference plane Fm of the target excavation landform.

In the present embodiment, when causing the display device 34 to display an image in bucket front viewing, the display controller 47 calculates a normal vector F of a plane defined by the blade edge vector B and a vector Z parallel to the Zm-axis of the vehicle body coordinate system. That is, the display controller 47 calculates the normal vector F on the basis of equation (13).

$$\vec{F}=\vec{B}\times\vec{Z} \tag{13}$$

The blade edge vector B is not orthogonal to the vector Z. The display controller 47 calculates a blade edge vector B' existing on a plane including the blade edge vector B and orthogonal to the vector Z. That is, the display controller 47 calculates the blade edge vector B' on the basis of equation (14).

$$\vec{B}'=\vec{Z}\times\vec{F} \tag{14}$$

The display controller 47 displays an image in bucket front viewing in a coordinate system with the abscissa representing the blade edge vector B' and the ordinate representing the vector Z. In the case illustrated in FIG. 11, the abscissa and ordinate of the front view 52A represent the blade edge vector B' and the vector Z, respectively.

When such coordinate transformation is executed, the display controller 47 causes the display device 34 to display the fixed target line Lr and the rotating icon 64 when the bucket 9 actually tilts and rotates.

[Effects]

As described above, according to the present embodiment, the blade edge vector B is calculated on the basis of working equipment outer shape data and working equipment state data, and an image in bucket front viewing is generated on the basis of the blade edge vector B and the target plane Fm indicating the target shape of an excavation object and displayed on the display device 34. With this operation, when the actual blade edge line LBT of the bucket 9 is parallel to the target plane Fm, the blade edge line LBT and the target line Lr are also displayed on an image in bucket front viewing so as to be parallel to each other.

As described with reference to FIGS. 14 and 15, on an image in operator front viewing, the target line Ln may be displayed so as to be inclined relative to the blade edge line LBT even when the actual blade edge line LBT of the bucket 9 is parallel to the target plane Fm. As described above, the relative position between the bucket 9 and the target plane Fm may not be accurately displayed depending on the direction in which the bucket 9 and the target plane Fm of an excavation object are viewed. If the relative position between the bucket 9 and the target plane Fm is not accurately displayed, the operator may feel uncomfortable about the image displayed on the display device 34 or the operation of the operating device 35 by the operator may not be sufficiently assisted.

According to the present embodiment, because an image in bucket front viewing is generated, when the actual blade edge line LBT of the bucket 9 is parallel to the target plane Fm, the blade edge line LBT displayed on the display device 34 is parallel to the target line Lr. Accurately displaying the relative position between the bucket 9 and the target plane Fm will prevent the operator from feeling uncomfortable about the image displayed on the display device 34 and sufficiently assist the operator to operate the operating device 35.

In the present embodiment, the bucket 9 is a tilt bucket that can rotate about each of the bucket rotation axis AX3 as the first rotation axis and the tilt rotation axis AX4 as the second rotation axis. The blade edge vector B is orthogonal to an axis parallel to the tilt rotation axis AX4. In an image in operator front viewing, as the bucket 9 tilts and rotates, it is highly possible that the actual relative position between the actual blade edge line LBT of the bucket 9 and the target plane Fm does not coincide with the relative position between the target line Ln and the blade edge line LBT displayed on the image in operator front viewing, and the relative position between the bucket 9 and the target excavation landform cannot be accurately displayed. In the present embodiment, an image in bucket front viewing is an image viewed from a direction orthogonal to the blade edge vector B. Accordingly, an image in bucket front viewing can accurately display the relative position between the actual blade edge line LBT of the bucket 9 and the target plane Fm.

In the present embodiment, as described with reference to FIGS. 14 and 15, an image in operator front viewing is generated with reference to the Ym-axis of the vehicle body coordinate system. In the comparative example described with reference to FIG. 15, therefore, when the blade edge line LBT is parallel to the target plane Fm, an image in operator front viewing cannot indicate that the blade edge line LBT is parallel to the target plane Fm. In this case, the operator may feel uncomfortable about the image displayed on the display device 34, and the operation of the sound output device 35 by the operator may not be sufficiently assisted. In contrast to this, in the present embodiment, it can be indicated that the blade edge line LBT is parallel to the target plane Fm. This can prevent the operator from feeling uncomfortable about the image displayed on the display device 34 and sufficiently assist the operator to operate the sound output device 35.

Other Embodiments

In the embodiments described above, the reference vector B passes through the blade edge 9T. The reference vector B may not pass through the blade edge 9T as long as it extends in the widthwise direction of the bucket B. For example, the reference vector B may pass through a specified portion of the outer surface of the bucket 9.

In the embodiment described above, as an image in bucket front viewing, both the icon 64 as an image illustrating the position of the bucket 9 and the line image 66 as an image illustrating the position of the blade edge line LBT are displayed on the display device 34. As described above, the line image 66 is an image illustrating the position of the blade edge 9T of the bucket 9. The display controller 47 may cause the display device 34 to display the line image 66 without displaying the icon 64. Even if the icon 64 is not displayed, when the line image 66 and the target line Lr are displayed on the display device 34, the operator can recognize the relative position between the bucket 9 and the reference plane Lm. The display controller 47 may cause the display device 34 to display the line image 66 without displaying the icon 64.

An image in bucket front viewing is only required to allow the operator to recognize, for example, the relative position between the reference vector B and at least part of the target excavation landform. For example, this image does not need to display the overall target line Lr as long as the image displays the relative position between the position 9TA of the blade edge 9T of the bucket 9 and a point on the target line Lr which is located at the shortest distance from the position 9TA and a point on the target line Lr which is located at the shortest distance from the position 9TB of the blade edge 9T of the bucket 9.

Note that in the embodiment described above, the bucket 9 is a tilt bucket, and the rotation axis AX3 as a bucket rotation axis is orthogonal to an axis parallel to the rotation axis AX4 as a tilt rotation axis. The working equipment 2 may be working equipment designed such that the rotation axis AX3 is not orthogonal to an axis parallel to the rotation axis AX4. Even when the rotation axis AX3 is not orthogonal to an axis parallel to the rotation axis AX4, storing working equipment data concerning the working equipment in the working equipment data storage unit 41 allows the display controller 47 to cause the display device 34 to display an image in bucket front viewing.

Note that in the embodiment described above, the bucket 9 can rotate about the two rotation axes AX3 and AX4 relative to the arm 7. The bucket 9 may be a bucket (without any tilt function) that rotates about only the rotation axis AX3 relative to the arm 7.

Note that an excavation machine is not limited to an excavator as long as the machine is configured to perform excavation. Although the present invention exemplifies the machine that the operator boards, the present invention may be applied to an excavation machine including a remote function that transmits an operation command from outside the excavator.

REFERENCE SIGNS LIST

1 EXCAVATOR (EXCAVATION MACHINE)
2 WORKING EQUIPMENT
3 SWING BODY
3EG ENGINE ROOM
4 OPERATING ROOM
5 TRAVELING DEVICE
5C CRAWLER TRACK
6 BOOM
7 ARM
8 COUPLING MEMBER
9 BUCKET
9T BLADE EDGE
9TG BLADE EDGE ARRAY
10 BOOM CYLINDER
11 ARM CYLINDER
12 BUCKET CYLINDER
13 TILT CYLINDER
14 BOOM PIN
15 ARM PIN
16 BUCKET PIN
17 TILT PIN
18 DETECTION SYSTEM
19 WORKING EQUIPMENT ANGLE DETECTOR
19A BOOM STROKE SENSOR
19B ARM STROKE SENSOR
19C BUCKET STROKE SENSOR
19D BUCKET ANGLE SENSOR
20 POSITION DETECTOR
21, 22 GNSS ANTENNA
23 POSITION CALCULATOR
24 POSTURE CALCULATOR
25 VEHICLE CONTROLLER
26 HYDRAULIC SYSTEM
27 HYDRAULIC PUMP
28 FLOW CONTROL VALVE
29 PROPORTIONAL CONTROL VALVE
30 OPERATING DEVICE
31 WORKING LEVER
31L LEFT WORKING LEVER
31R RIGHT WORKING LEVER
31T TILT LEVER
32 TRAVELING LEVER
32L LEFT TRAVELING LEVER
32R RIGHT TRAVELING LEVER
33 INPUT DEVICE

34 DISPLAY DEVICE
35 SOUND OUTPUT DEVICE
40 CONTROLLER
40A INPUT/OUTPUT INTERFACE
40B STORAGE DEVICE
40C ARITHMETIC PROCESSOR
41 WORKING EQUIPMENT DATA STORAGE UNIT
42 TARGET EXCAVATION LANDFORM DATA STORAGE UNIT
43 VEHICLE STATE DATA ACQUISITION UNIT
44 WORKING EQUIPMENT STATE DATA ACQUISITION UNIT
45 TARGET EXCAVATION LANDFORM DATA ACQUISITION UNIT
46 CALCULATOR
47 DISPLAY CONTROLLER
50 GUIDE SCREEN
51 COARSE EXCAVATION SCREEN
51A FRONT VIEW
51B SIDE VIEW
52 FINE EXCAVATION SCREEN
52A FRONT VIEW
52B SIDE VIEW
52C PLAN VIEW
61 ICON
62 ICON
63 GRAPHIC
63A INDEX BAR
63B INDEX MARK
64 ICON
65 ICON
66 LINE IMAGE
67 LINE IMAGE
70 FACING COMPASS (GUIDE DISPLAY DATA)
71 GUIDE
100 CONTROL SYSTEM
200 DISPLAY SYSTEM
AX1, AX2, AX3, AX4 ROTATION AXIS
AXZ AXIS
B BLADE EDGE VECTOR (REFERENCE VECTOR)
Fa DESIGN PLANE
Fm TARGET PLANE
LBT BLADE EDGE LINE
Lm TARGET LINE
Lr TARGET LINE
LX INTERSECTION LINE
N NORMAL VECTOR
WP OPERATION PLANE
θ1 TILT ANGLE
θ2 TILT ANGLE
θ3 TILT ANGLE
θ4 TILT ANGLE
θ5 ROLL ANGLE
θ6 PITCH ANGLE
θ7 AZIMUTH ANGLE

The invention claimed is:

1. A display system for an excavation machine, comprising:

a calculator configured to calculate, based on vehicle state data indicating a position and a posture of a vehicle body of an excavation machine, working equipment outer shape data indicating an outer shape and a dimension of working equipment supported by the vehicle body, and working equipment state data indicating a posture of the working equipment, a reference vector extending in a widthwise direction of a bucket of the working equipment and passing through a blade edge of the bucket;

a processor and a memory, including computer program code, wherein the computer program code, when executed by operation of the, causes an operation to be performed comprising:

defining with a target excavation landform data acquisition unit, an operation plane passing through the blade edge of the bucket and orthogonal to a rotation axis of the bucket, the operation plane being a plane in which the blade edge of the bucket is moved by actuation of the working equipment toward a target plane of a target excavation landform indicating a target shape of an excavation object to be excavated by the bucket;

defining with the target excavation landform data acquisition unit, a point on the target plane, whose vertical distance from the bucket through the operation plane is shortest identifying a target line; and a display controller configured to cause a display device to display the bucket and a target line on the target plane viewed from a direction orthogonal to the reference vector;

wherein an image in a bucket front view is generated based on the reference vector and the target plane indicating the target line of the target shape of the excavation object and displayed on the display device.

2. The display system for an excavation machine according to claim 1, wherein the target line is defined by an intersection line between a plane including the reference vector and orthogonal to a target plane of a target excavation landform of an excavation object and the target plane.

3. The display system for an excavation machine according to claim 1, wherein the working equipment includes an arm supporting the bucket, and the bucket is rotatable about each of a first rotation axis and a second rotation axis facing a direction different from the first rotation axis relative to the arm.

4. The display system for an excavation machine according to claim 1, wherein the display controller causes the display device to display guide display data for making the reference vector directly face the target line.

5. An excavation machine comprising the display system for the excavation machine defined in claim 1.

6. A display method for an excavation machine, comprising causing an arithmetic processor to acquire vehicle state data indicating a position and a posture of a vehicle body of an excavation machine, working equipment outer shape data indicating an outer shape and a dimension of the working equipment supported by the vehicle body, and working equipment state data indicating a posture of the working equipment, calculate a reference vector extending in a widthwise direction of a bucket of the working equipment and passing through a blade edge of the bucket based on the vehicle state data, the working equipment outer shape data, and the working equipment state data, define an operation plane passing through the blade edge of the bucket and orthogonal to a rotation axis of the bucket, the operation plane being a plane in which the blade edge of the bucket is moved by actuation of the working equipment toward a target plane of a target excavation landform indicating a target shape of an excavation object to be excavated by the bucket;

define a point on the target plane, whose vertical distance from the bucket through the operation plane is shortest identifying a target line; and output the bucket and a target line viewed from a direction orthogonal to the reference vector to a display device;

wherein an image in a bucket front view is generated based on the reference vector and the target plane indicating the target line of the target shape of the excavation object and displayed on the display device.

* * * * *